US011493259B2

(12) United States Patent
Cha et al.

(10) Patent No.: US 11,493,259 B2
(45) Date of Patent: Nov. 8, 2022

(54) REFRIGERATOR INCLUDING CABINET AND COOLING MODULE DETACHABLY MOUNTED ON THE CABINET

(71) Applicant: Samsung Electronics Co., Ltd., Suwon-si (KR)

(72) Inventors: Jangyong Cha, Suwon-si (KR); In-Yong Hwang, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 326 days.

(21) Appl. No.: 16/894,695

(22) Filed: Jun. 5, 2020

(65) Prior Publication Data

US 2020/0386469 A1 Dec. 10, 2020

(30) Foreign Application Priority Data

Jun. 7, 2019 (KR) ..... 10-2019-0067185

(51) Int. Cl.
*H01R 13/514* (2006.01)
*F25D 17/06* (2006.01)
(Continued)

(52) U.S. Cl.
CPC ..... *F25D 17/065* (2013.01); *H01R 9/16* (2013.01); *H01R 13/426* (2013.01); *H01R 13/506* (2013.01); *H01R 13/514* (2013.01); *H01R 13/627* (2013.01); *H01R 13/64* (2013.01); *H01R 25/006* (2013.01); *Y10S 439/928* (2013.01)

(58) Field of Classification Search
CPC ..... F25D 17/065; H01R 9/16; H01R 13/426; H01R 13/506; H01R 13/514; H01R 13/627; H01R 13/64; H01R 25/006; Y10S 439/928
See application file for complete search history.

(56) References Cited

U.S. PATENT DOCUMENTS 3,399,374 A * 8/1968 Pauza ..... H01R 13/514 439/680
11,306,960 B2 * 4/2022 Hong ..... F25D 19/00
(Continued)

FOREIGN PATENT DOCUMENTS

DE 0660448 A2 * 6/1995
JP 06-213553 A 8/1994
(Continued)

OTHER PUBLICATIONS

International Search Report dated Sep. 28, 2020 in connection with International Patent Application No. PCT/KR2020/007252, 3 pages.

*Primary Examiner* — Tho D Ta

(57) ABSTRACT

A refrigerator including a cabinet in which an electronic device is disposed, a cooling module provided with a cooling air supply system and detachably mounted on an outer side of the cabinet, a cabinet connection device electrically connected to the electronic device and including a cabinet fixing member fixed to the cabinet and a cabinet connector bufferably mounted to the cabinet fixing member, and a module connection device electrically connected to the cooling air supply system and including a module fixing member fixed to the cooling module and a module connector bufferably mounted to the module fixing member.

20 Claims, 16 Drawing Sheets

(51) Int. Cl.

| | |
|---|---|
| *H01R 9/16* | (2006.01) |
| *H01R 13/426* | (2006.01) |
| *H01R 13/506* | (2006.01) |
| *H01R 13/627* | (2006.01) |
| *H01R 13/64* | (2006.01) |
| *H01R 25/00* | (2006.01) |

(56) References Cited

U.S. PATENT DOCUMENTS

| | | | | |
|---|---|---|---|---|
| 11,353,255 | B2 * | 6/2022 | Hwang | F25D 23/087 |
| 2011/0126569 | A1 | 6/2011 | Selin et al. | |
| 2013/0305770 | A1 | 11/2013 | Grewal et al. | |
| 2020/0200462 | A1 * | 6/2020 | Jeon | F25D 17/045 |
| 2020/0200467 | A1 * | 6/2020 | Park | F25D 11/022 |

FOREIGN PATENT DOCUMENTS

| | | | | |
|---|---|---|---|---|
| JP | 3099634 | B2 | | 10/2000 |
| JP | 2004069242 | A | | 3/2004 |
| JP | 2005005135 | A | | 1/2005 |
| KR | 10-0870529 | B1 | | 11/2008 |
| KR | 10-2011-0029135 | A | | 3/2011 |
| KR | 20200076460 | A | * | 6/2020 |
| WO | 2005/106362 | A1 | | 11/2005 |

* cited by examiner

REFRIGERATOR INCLUDING CABINET AND COOLING MODULE DETACHABLY MOUNTED ON THE CABINET

CROSS-REFERENCE TO RELATED APPLICATION

This application is based on and claims priority under 35 U.S.C. § 119 to Korean Patent Application No. 10-2019-0067185 filed on Jun. 7, 2019 in the Korean Intellectual Property Office, the disclosure of which is incorporated by reference herein in its entirety.

BACKGROUND

1. Field

The disclosure relates to a refrigerator, and more particularly, to a refrigerator having an improved structure of a cool air supply system.

2. Description of Related Art

Generally, a refrigerator is an appliance that keeps food fresh by including a main body provided with a storage chamber therein and a cool air supply system for supplying cool air to the storage chamber. The storage chamber includes a refrigerating chamber that is maintained at temperature of about 0 degrees Celsius to 5 degrees to keep food refrigerated, and a freezing chamber that is maintained at temperature of about 0 degrees Celsius to 30 degrees below zero to keep food frozen.

In the refrigerator, an insulating material is provided in a cabinet forming the storage chamber, and a machine room is disposed outside the cabinet. Among components constituting the cool air supply system, a compressor and a condenser are located in the machine room disposed outside the cabinet, an evaporator is located in the storage chamber disposed inside the cabinet, and a refrigerant pipe through which a refrigerant moves penetrates the insulating material.

Accordingly, when the cooling performance of the cool air supply system of the refrigerator is tested, the cooling performance test should be performed only after all components of the cool air supply system are installed in the cabinet. In addition, when the cool air supply system needs to be maintained and repaired, the cabinet should be disassembled.

SUMMARY

It is an aspect of the disclosure to provide a refrigerator capable of easily maintaining a cool air supply system.

It is another aspect of the disclosure to provide a refrigerator capable of easily electrically connecting a cooling module to a cabinet.

It is another aspect of the disclosure to provide a refrigerator capable of enhancing productivity by improving the manufacturing process.

Additional aspects of the disclosure will be set forth in part in the description which follows and, in part, will be obvious from the description, or may be learned by practice of the disclosure.

In accordance with an aspect of the disclosure, a refrigerator includes a cabinet in which an electronic device is disposed, a cooling module provided with a cooling air supply system and detachably mounted on an outer side of the cabinet, a cabinet connection device electrically connected to the electronic device and including a cabinet fixing member fixed to the cabinet and a cabinet connector bufferably mounted to the cabinet fixing member, and a module connection device electrically connected to the cooling air supply system and including a module fixing member fixed to the cooling module and a module connector bufferably mounted to the module fixing member.

The cabinet connection device may further include a cabinet buffer member disposed between the cabinet fixing member and the cabinet connector, the cabinet buffer member comprised of a material having elasticity.

The cabinet connection device may further include a cabinet guide configured to guide movement of the module connection device in a coupling direction when the cabinet connection device is coupled to the module connection device.

The cabinet connection device may further include a cabinet aligning portion disposed adjacent to the cabinet guide to guide the movement of the module connection device in the coupling direction together with the cabinet guide when the cabinet connection device is coupled to the module connection device, and the module connection device may further include a module aligning portion corresponding to the cabinet aligning portion.

The module connection device may further include a module guide formed in a shape corresponding to the cabinet guide and configured to be guided by the cabinet guide.

The cabinet guide may be formed in a groove shape, and the module guide may be formed in a protrusion shape and is configured to be inserted into the cabinet guide.

The cabinet connection device may further include a cabinet terminal disposed at an inner end of the cabinet guide, and the module connection device may further include a module terminal protruding from an end of the module guide and is configured to be electrically connected to the cabinet terminal.

The cabinet fixing member may include a cabinet fixing opening through which a portion of the cabinet connector is inserted and fixed, and a cabinet wire electrically connecting the cabinet connector to the electronic device may be disposed to pass through the cabinet fixing opening.

The cabinet connector may include a cabinet leg inserted into and fixed to the cabinet fixing opening.

The cabinet connector may further include a cabinet connector protrusion including a material having elasticity, and the cabinet connector is supported by the cabinet fixing member in a direction opposite to a direction in which the cabinet leg is supported.

The module connection device may include further a module buffer member disposed between the module fixing member and the module connector, the module buffer member comprised of a material having elasticity.

The module fixing member may further include a module fixing opening through which a portion of the module connector is inserted and fixed, and a module wire electrically connecting the module connector to the cool air supply system may be disposed to pass through the module fixing opening.

The module connector may further include a module leg inserted into and fixed to the module fixing opening.

The module connector may further include a module connector protrusion including a material having elasticity, and the module connector is supported by the module fixing member in a direction opposite to a direction in which the module leg is supported.

The module connector protrusion may be configured to be in contact with an inner surface of the module fixing member to limit movement of the module connector.

In accordance with another aspect of the disclosure, a refrigerator includes a cabinet in which an electronic device is disposed, a cooling module provided with a cooling air supply system and detachably mounted on an outer side of the cabinet, a cabinet connection device electrically connected to the electronic device and including a cabinet fixing member fixed to the cabinet and a cabinet connector mounted to the cabinet fixing member and provided with a cabinet guide extending along a direction in which the cooling module is coupled to the cabinet, and a module connection device electrically connected to the cooling air supply system and including a module fixing member fixed to the cooling module and a module connector mounted to the module fixing member and provided with a module guide formed in a shape corresponding to the cabinet connector to be guided by the cabinet connector.

The cabinet connection device may further include a cabinet buffer member disposed between the cabinet fixing member and the cabinet connector, the cabinet buffer member comprised of a material having elasticity, and the module connection device may further include a module buffer member disposed between the module fixing member and the module connector, the module buffer member comprised of a material having elasticity.

The cabinet fixing member may include a cabinet fixing opening through which a portion of the cabinet connector is inserted and fixed and through which a cabinet wire electrically connecting the cabinet connector to the electronic device passes, and the module fixing member may include a module fixing opening through which a portion of the module connector is inserted and fixed and through which a module wire electrically connecting the module connector to the cool air supply system passes.

The cabinet connector may include a cabinet leg inserted into and fixed to the cabinet fixing opening, and the module connector may include a module leg inserted into and fixed to the module fixing opening.

The cabinet connector may further include a cabinet connector protrusion including a material having elasticity and the cabinet connector is supported by the cabinet fixing member in a direction opposite to a direction in which the cabinet leg is supported, and the module connector may further include a module connector protrusion including a material having elasticity and the module connector is supported by the module fixing member in a direction opposite to a direction in which the module leg is supported.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
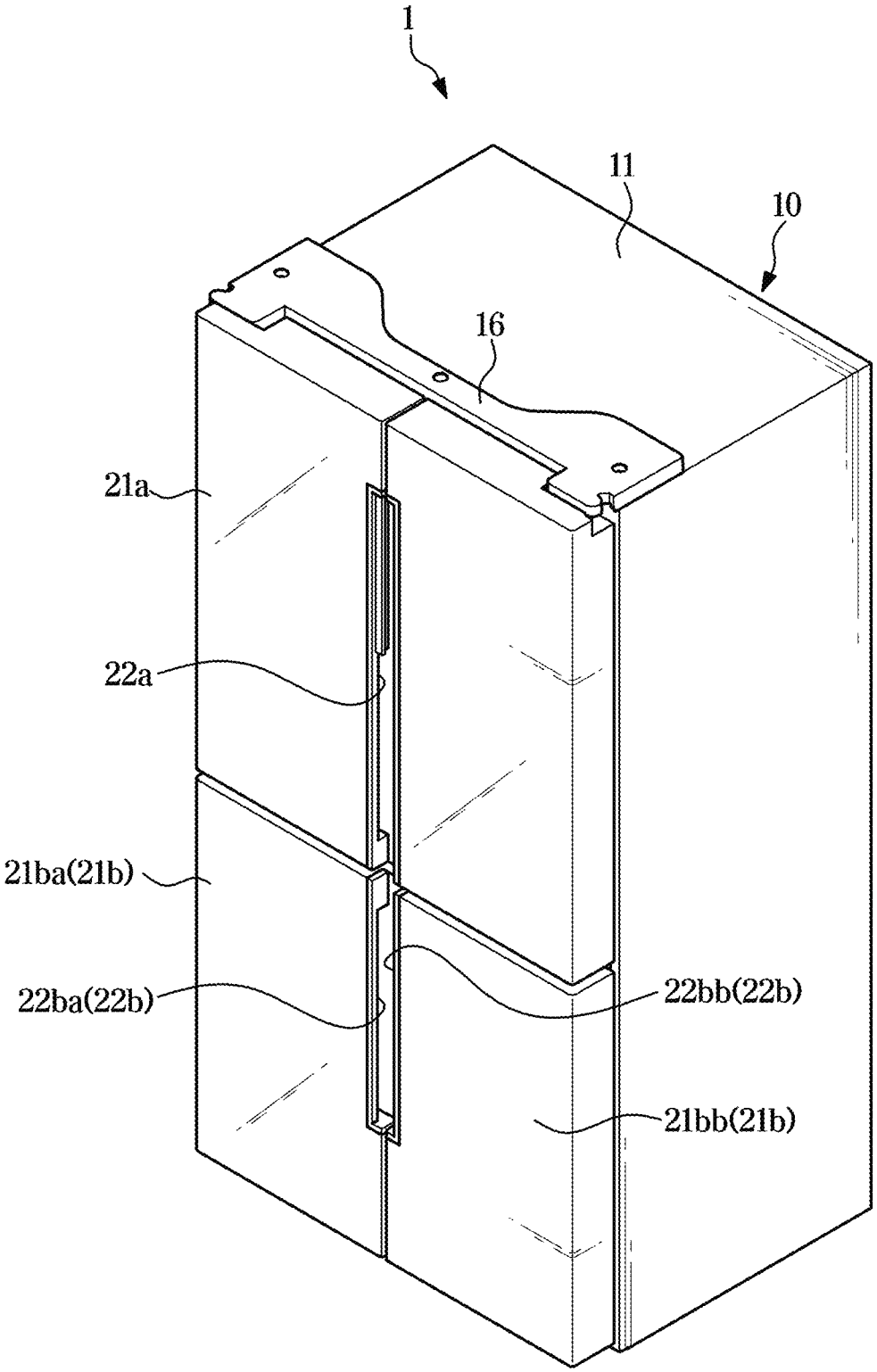
FIG. 1 illustrates a perspective view of a refrigerator according to an embodiment of the disclosure.

FIGS. 1 through 16, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Configurations illustrated in the embodiments and the drawings described in the present specification are only the preferred embodiments of the present disclosure, and thus it is to be understood that various modified examples, which may replace the embodiments and the drawings described in the present specification, are possible when filing the present application.

Like reference numerals or symbols denoted in the drawings of the present specification represent members or components that perform the substantially same functions.

The terms used in the present specification are used to describe the embodiments of the present disclosure. Accordingly, it should be apparent to those skilled in the art that the following description of exemplary embodiments of the present invention is provided for illustration purpose only and not for the purpose of limiting or/or restricting the invention. It is to be understood that the singular forms "a," "an," and "the" include plural referents unless the context clearly dictates otherwise. It will be understood that when the terms "includes," "comprises," "including," and/or "comprising," when used in this specification, specify the presence of stated features, figures, steps, components, or combination thereof, but do not preclude the presence or addition of one or more other features, figures, steps, components, members, or combinations thereof.

It will be understood that although the terms first, second, etc. may be used herein to describe various components, these components should not be limited by these terms, and the terms are only used to distinguish one component from another. For example, without departing from the scope of the present invention, the first component may be referred to as a second component, and similarly, the second component may also be referred to as a first component. The term "and/or" includes any combination of a plurality of related items or any one of a plurality of related items. As used herein, the term "and/or" includes any and all combinations of one or more of associated listed items.

In the following description, the terms "front direction", "rear direction", "upper portion", "lower portion", etc. are defined based on the drawings, and the shapes and positions of the components are not limited by the terms.

Hereinafter, embodiments of the disclosure will be described in detail with reference to the accompanying drawings.

Figure 2:
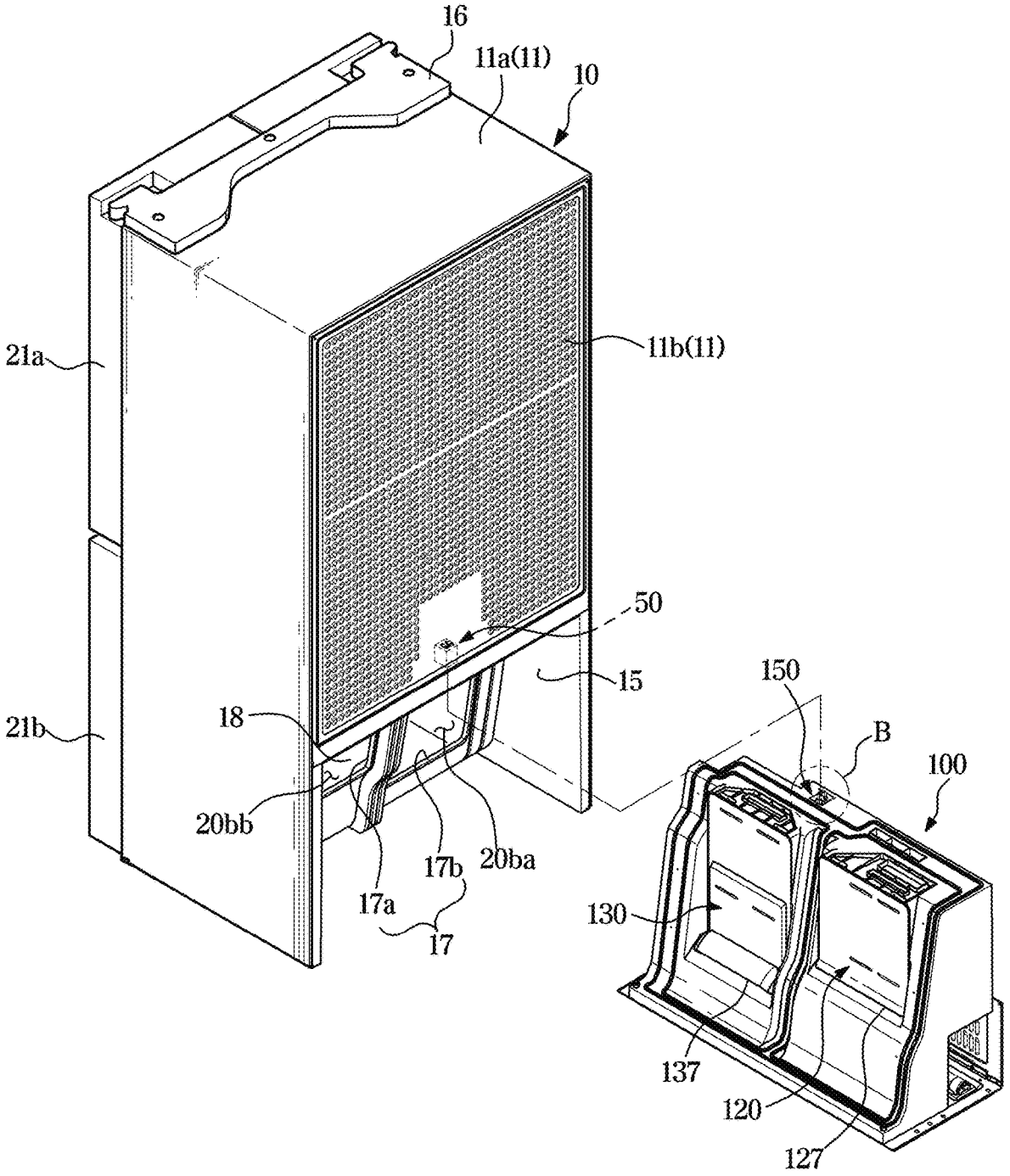
FIG. 2 illustrates a state in which a cooling module is separated from a cabinet of the refrigerator illustrated in FIG. 1.
Figure 3:
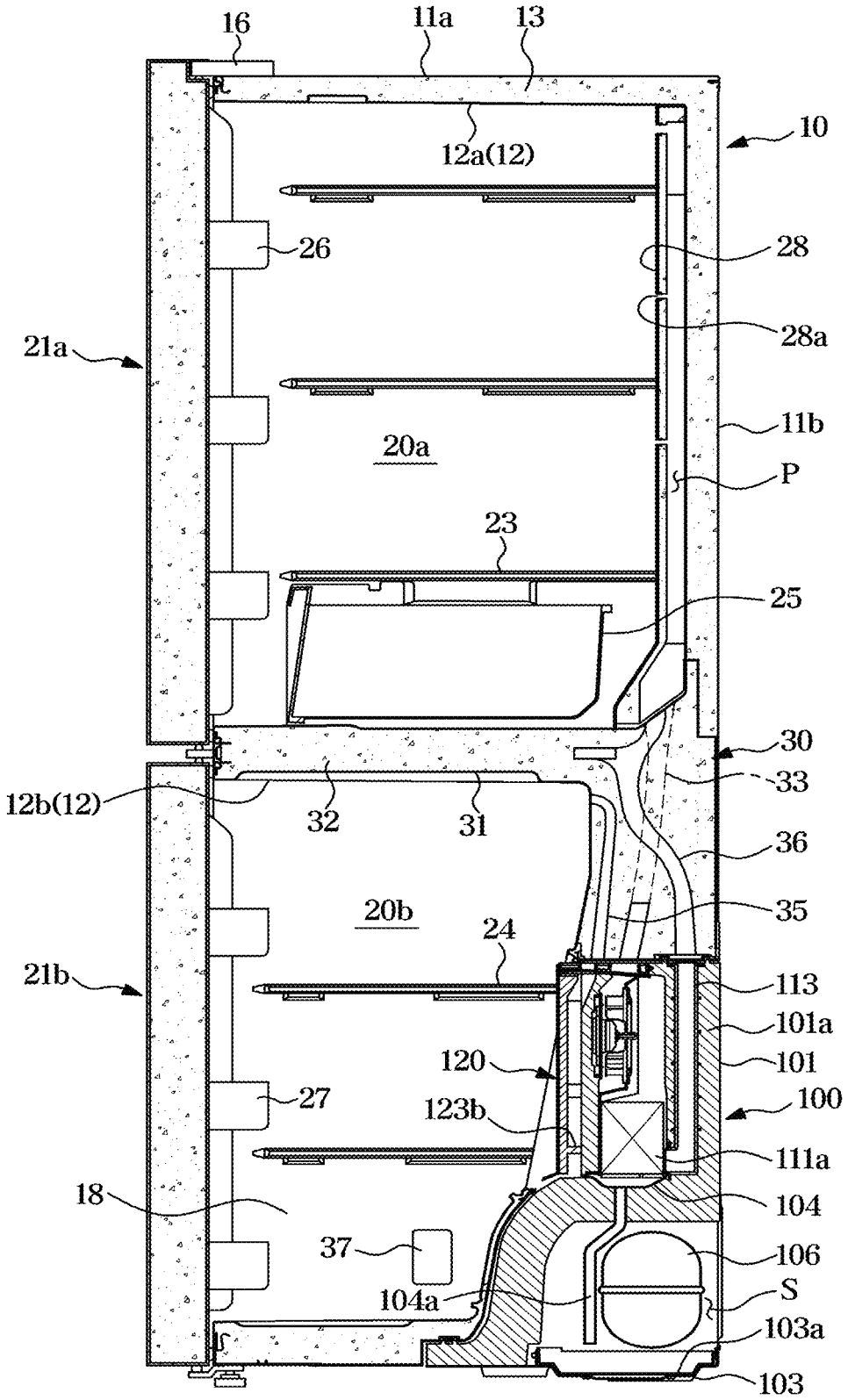
FIG. 3 illustrates a cross-sectional view of the refrigerator illustrated in FIG. 1.

FIG. 1 illustrates a perspective view of a refrigerator according to an embodiment of the disclosure, FIG. 2 illustrates a state in which a cooling module is separated from a cabinet of the refrigerator illustrated in FIG. 1, and FIG. 3 illustrates a cross-sectional view of the refrigerator illustrated in FIG. 1.

Referring to FIGS. 1 to 3, a refrigerator 1 may include a cabinet 10 forming a plurality of storage chambers 20*a* and 20*b*, a plurality of doors 21*a* and 21*b* configured to open and close the storage chambers 20*a* and 20*b*, and a cooling module 100 detachably coupled to the cabinet 10 and configured to supply cool air to the storage chambers 20*a* and 20*b*.

The cabinet 10 may include an outer case 11, and an inner case 12 coupled to an inner side of the outer case 11. The outer case 11 may include a cabinet body 11*a*, wherein front and rear sides of the cabinet body 11*a* open, and a cabinet cover 11*b* covering the rear side of the cabinet body 11*a*. The front side of the cabinet body 11*a* may be covered by the doors 21*a* and 21*b*. The outer case 11 may be made of a metal material.

The inner case 12 may form the storage chambers 20*a* and 20*b*. The inner case 12 may be formed by injection-molding a plastic material. The inner case 12 may include a first inner case 12*a* forming the upper storage chamber 20*a*, and a second inner case 12*b* forming the lower storage chamber 20*b*.

A cabinet insulator 13 may be provided between the outer case 11 and the inner case 12. The cabinet insulator 13 may be urethane foam insulation, and may be used together with a vacuum insulation panel, as necessary.

The cabinet 10 may include a middle body 30 disposed between the first inner case 12*a* and the second inner case 12*b*. The middle body 30 may include a partition 31 for partitioning the storage chambers 20*a* and 20*b* into the upper chamber 20*a* and the lower chamber 20*b*. The middle body 30 may include a middle body insulator 32 therein to prevent heat exchange between the upper storage chamber 20*a* and the lower storage chamber 20*b*. The middle body insulator 32 may prevent a loss of cool air from a portion of a rear side of the lower storage chamber 20*b* to an outside.

In the middle body 30, a first cool air duct 33, a second cool air duct (not shown), a third cool air duct 35, and a first circulation duct 36 may be disposed. The first cool air duct 33, the second cool air duct, the third cool air duct 35, and the first circulation duct 36 may penetrate the middle body insulator 32.

The first cool air duct 33 may guide cool air generated by a first evaporator 111*a* to the first storage chamber 20*a*. The second cool air duct may guide cool air generated by a second evaporator 111*b* to a second storage chamber 20*ba*. The third cool air duct 35 may guide cool air generated by the second evaporator 111*b* to a third storage chamber 20*bb*. The first circulation duct 36 may guide air that has cooled the first storage chamber 20*a* to the first evaporator 111*a*. The second cool air duct may be formed similarly to the third cool air duct 35.

Front sides of the storage chambers 20*a* and 20*b* may open to put food in or out. The storage chambers 20*a* and 20*b* may include the upper storage chamber 20*a* and the lower storage chamber 20*b*. The upper storage chamber 20*a* may be used as a refrigerating chamber that is maintained at about 0 degrees Celsius to 5 degrees to keep food refrigerated. The upper storage chamber 20*a* is also referred to as the first storage chamber 20*a*.

Referring to FIG. 3, in the first storage chamber 20*a*, a guide cover 28 may be disposed to distribute cool air supplied from the first cool air duct 33. The guide cover 28 may form a passage P through which cool air transferred from the first cool air duct 33 flows, together with the first inner case 12*a*.

The guide cover 28 may include a guide hole 28*a* for supplying cool air transferred from the first cool air duct 33 to the first storage chamber 20*a*. A plurality of the guide holes 28*a* may be arranged along up and down directions.

The lower storage chamber 20*b* may include the second storage chamber 20*ba* and the third storage chamber 20*bb*. The cabinet 10 may include a separation plate 18 for partitioning the second storage chamber 20*ba* and the third storage chamber 20*bb*. The second storage chamber 20*ba* may be used as a freezing chamber that is maintained at about 0 degrees Celsius to 30 degrees below zero to store food frozen. The third storage chamber 20*bb* may be used as a temperature changing chamber where temperature changes. However, the use of the first storage chamber 20*a*, the second storage chamber 20*ba*, and the third storage chamber 20*bb* may change.

The open front sides of the storage chambers 20*a* and 20*b* may be opened and closed by the doors 21*a* and 21*b*. In the storage chambers 20*a* and 20*b*, a plurality of shelves 23 and 24 on which food may be placed, and a storage container 25 in which food may be stored may be provided.

The upper door 21*a* may open and close the first storage chamber 20*a*. The upper door 21*a* may be coupled to the cabinet 10 to be rotatable in left and right directions. An upper door guard 26 for storing food may be provided on a rear surface of the upper door 21*a*. A hinge cover 16 may be provided at a portion of the cabinet 10 to which the upper door 21*a* is coupled. The upper door 21*a* may also be referred to as the first door 21*a*.

The first door 21*a* may include a first door handle 22*a*. A user may grip the first door handle 22*a* to open and close the first door 21*a*.

The lower door 21*b* may open and close the lower storage chamber 20*b*. The lower door 21*b* may be coupled to the cabinet 10 to be rotatable in the left and right directions. A lower door guard 27 for storing food may be provided on a rear surface of the lower door 21*b*. The lower door 21*b* may include a second door 21*ba* for opening and closing the second storage chamber 20*ba*, and a third door 21*bb* for opening and closing the third storage chamber 20*bb*.

The lower door 21*b* may include a lower door handle 22*b*. The user may grip the lower door handle 22*b* to open and close the lower door 21*b*. Specifically, the second door 21*ba* may include a second door handle 22*ba*, and the third door 21*bb* may include a third door handle 22*bb*.

A lower portion of the cabinet 10 may be provided with a cooling module mounting portion 15 to which the cooling module 100 is detachably mounted. The cooling module mounting portion 15 may be provided in a size and shape corresponding to the cooling module 100.

The cabinet 10 may include a duct opening 17. The duct opening 17 may be formed in the cooling module mounting portion 15. The duct opening 17 may be formed in a portion of the cabinet 10 facing the cooling module 100. The duct opening 17 may include a second duct opening 17*b* for communicating the second storage chamber 20*ba* with the cooling module mounting portion 15, and a first duct opening 17*a* for communicating the third storage chamber 20*bb* with the cooling module mounting portion 15.

Figure 4:
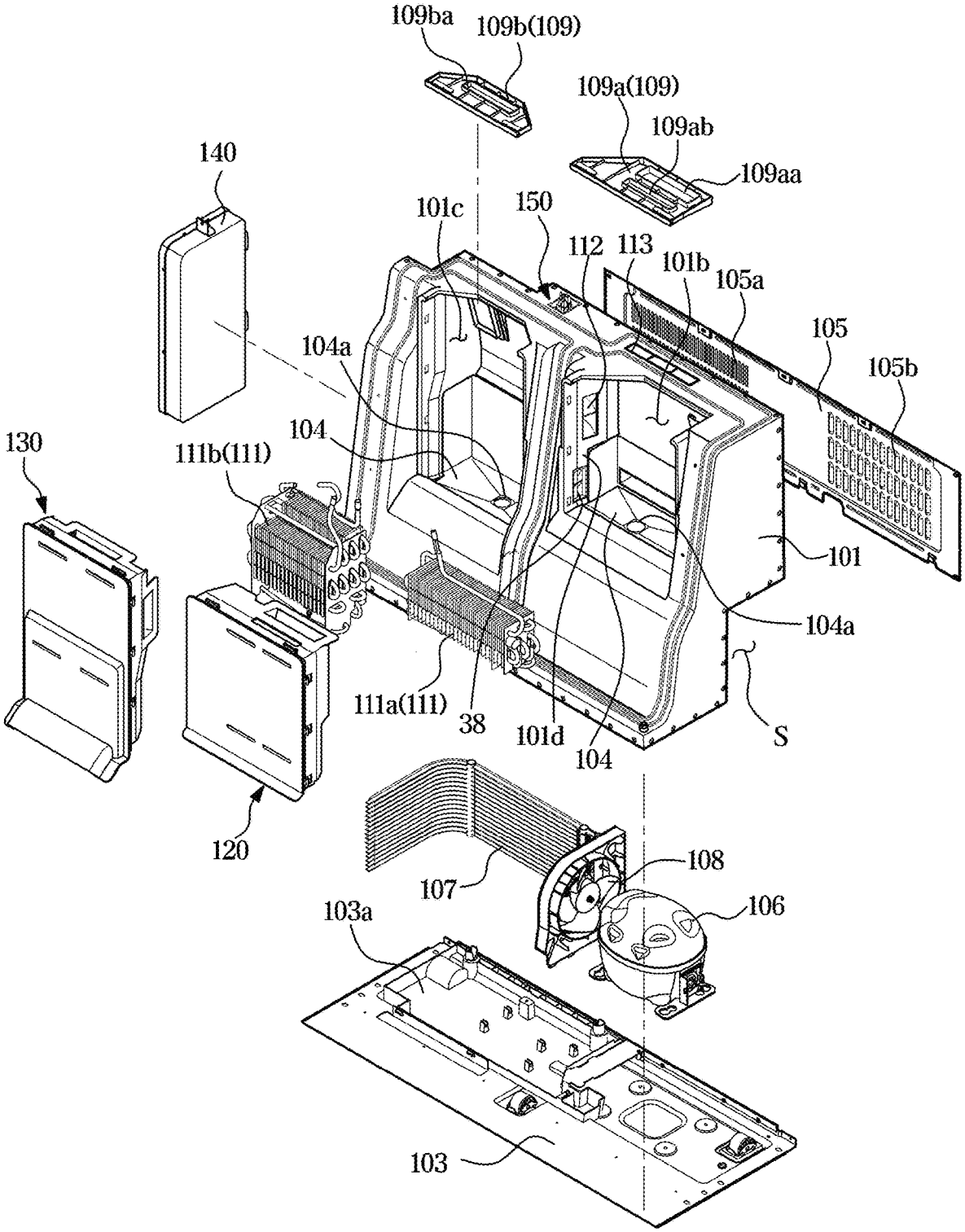
FIG. 4 illustrates an exploded perspective view of the cooling module illustrated in FIG. 2.
Figure 5:
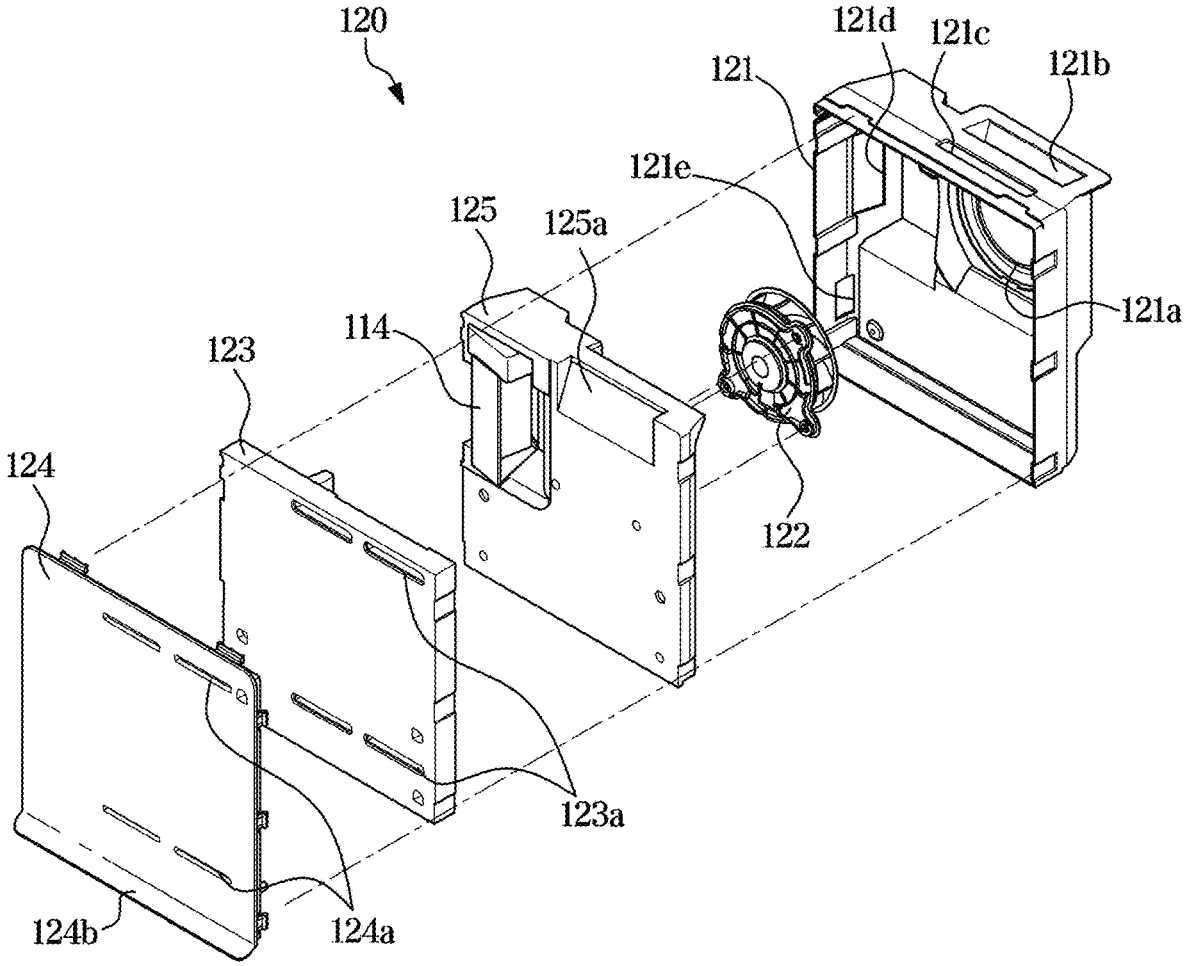
FIG. 5 illustrates an exploded perspective view of a first duct module illustrated in FIG. 4.
Figure 6:
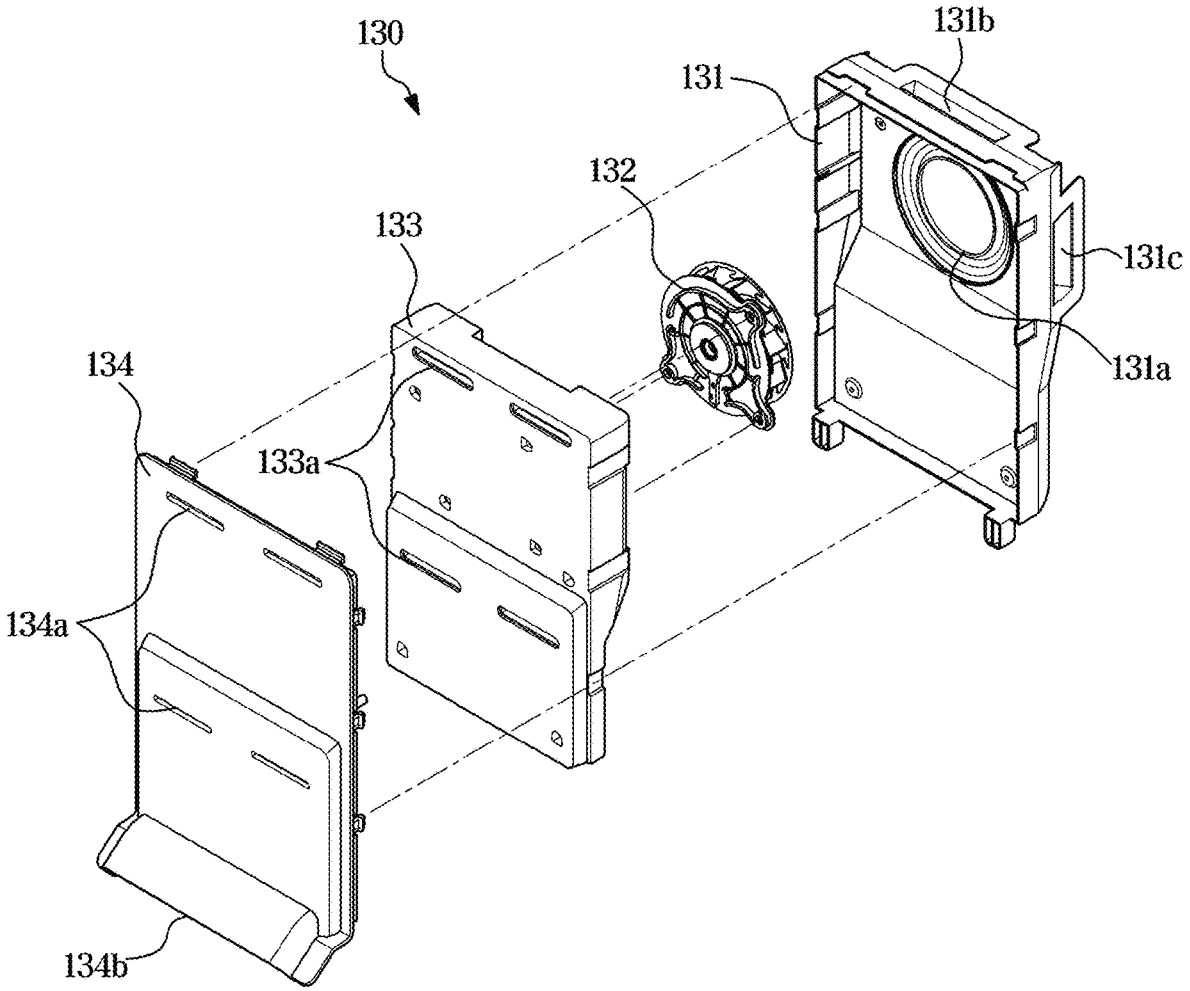
FIG. 6 illustrates an exploded perspective view of a second duct module illustrated in FIG. 4.

FIG. 4 illustrates an exploded perspective view of the cooling module illustrated in FIG. 2, FIG. 5 illustrates an exploded perspective view of a first duct module illustrated in FIG. 4, and FIG. 6 illustrates an exploded perspective view of a second duct module illustrated in FIG. 4.

The cooling module 100 may generate cool air by using evaporative latent heat of a refrigerant through a cooling cycle. The cooling module 100 may generate cool air to be supplied to the first storage chamber 20*a*, the second storage chamber 20*ba*, and the third storage chamber 20*bb*. The cooling module 100 may be detachably mounted to the cabinet 10 from the outside.

Referring to FIG. 4, the cooling module 100 may include a module body 101, a base plate 103, a compressor 106, a condenser 107, an evaporator 111, and an expansion valve (not shown).

The module body 101 may form a portion of a rear surface of the refrigerator 1. The module body 101 may include a module insulator 101*a* provided therein to prevent a loss of cool air generated from the evaporator 111.

The module body 101 may include accommodating spaces 101*b* and 101*c* in which the evaporator 111 is disposed. Specifically, the accommodating spaces 101*b* and 101*c* may include the first accommodating space 101*b* in which the first evaporator 111*a* is disposed, and the second accommodating space 101*c* in which the second evaporator 111*b* is disposed.

The module body 101 may include a separation wall 101*d* disposed between the first accommodating space 101*b* and the second accommodating space 101*c*. The separation wall 101*d* may correspond to a boundary between the second storage chamber 20*ba* and the third storage chamber 20*bb*. The module insulator 101*a* may also be disposed in an inside of the separation wall 101*d*.

In the separation wall 101*d*, a connection duct 112 may be provided to penetrate the module insulator 101*a*. The connection duct 112 may move cool air to be supplied to the third storage chamber 20*bb*. The connection duct 112 may communicate the first accommodating space 101*b* with the second accommodating space 101*c*. One end of the connection duct 112 may be connected to a first fan connection opening 121*d*, and the other end of the connection duct 112 may be connected to a second fan connection opening 131*c*.

In the separation wall 101*d*, a third circulation duct 38 may be provided to penetrate the module insulator 101*a*. The third circulation duct 38 may move air that has cooled the third storage chamber 20*bb* to the second evaporator 111*b*. The third circulation duct 38 may communicate the first accommodating space 101*b* with the second accommodating space 101*c*. The third circulation duct 38 may communicate a part of a space between a separation cover 125 and a first fan cover 123 with a space where the second evaporator 111*b* is disposed.

The module body 101 may be provided with a guide duct 113. The guide duct 113 may penetrate the module insulator 101*a* of the module body 101. The guide duct 113 may be connected to the first circulation duct 36. The guide duct 113 may communicate the first circulation duct 36 with the first accommodating space 101*b* where the first evaporator 111*a* is disposed.

The base plate 103 may be disposed below the module body 101. The base plate 103 may cover a bottom of the module body 101. The compressor 106 may be fixed to the base plate 103. The condenser 107 may be fixed to the base plate 103. A cooling fan 108 may be fixed to the base plate 103.

On the base plate 103, a collecting pan 103*a* may be disposed. The collecting pan 103*a* may collect condensate water generated by the condenser 107 and/or the evaporator 111. The condenser 107 may be disposed above the collecting pan 103*a*.

The module body 101 may include a plurality of drain pipes 104*a* and a plurality of drain pans 104 for guiding condensate water generated by the evaporator 111 to the collecting pan 103*a*. One of the drain pans 104 may be disposed below the evaporator 111. The drain pans 104 may be disposed below the first evaporator 111*a* and below the second evaporator 111*b*, respectively. The drain pans 104 may be disposed in the first accommodating space 101*b* and the second accommodating space 101*c*, respectively.

The drain pipes 104*a* may guide condensate water collected in the drain pans 104 to the collecting pan 103*a*. At least a portion of the drain pipes 104*a* may penetrate the module insulator 101*a*.

On the base plate 103, an electronic equipment box 140 may be disposed. The electronic equipment box 140 may be disposed on one side where the second accommodating space 101*c* is disposed. The electronic equipment box 140 may control the cooling module 100 to change temperature of the storage chambers 20*a* and 20*b*. The electronic equipment box 140 may be supplied power for driving the refrigerator 1. The electronic equipment box 140 may be electrically connected to an electronic device 40 disposed in the cabinet 10, and the compressor 106, the condenser 107, the expansion valve 116, the evaporator 111, the cooling fan 108, a first duct module 120, and a second duct module 130 which are disposed in the cooling module 100.

The module cover 105 may cover a rear lower portion of the module body 101. The module cover 105 may cover a machine room S which is provided in the lower portion of the module body 101 and in which the compressor 106, the condenser 107, and the cooling fan 108 are disposed, together with the base plate 103. The module cover 105 may include a cover inlet 105*a* through which outside air is introduced by the cooling fan 108, and a cover outlet 105*b* through which introduced air is discharged to the outside.

The compressor 106 may compress a refrigerant and move the refrigerant to the condenser 107. The condenser 107 may condense the refrigerant and move the refrigerant to the expansion valve. The cooling fan 108 may cool the compressor 106 and the condenser 107. When the cooling fan 108 is driven, air may be introduced into the machine room S through the cover inlet 105*a* and heat-exchanged with the condenser 107 and the compressor 106, and then discharged to the outside of the machine room S through the cover outlet 105*b*.

The module body 101, the base plate 103, and the module cover 105 described above may be collectively referred to as a module housing.

The evaporator 111 may generate cool air. The evaporator 111 may be disposed in the accommodating spaces 101*b* and 101*c*. The evaporator 111 may include the first evaporator 111*a* and the second evaporator 111*b*. The first evaporator 111*a* may be disposed in the first accommodating space 101*b*. The second evaporator 111*b* may be disposed in the second accommodating space 101*c*.

The cooling module 100 may include a cap 109 covering an open upper area of the accommodating spaces 101*b* and 101*c*. The cap 109 may include a first cap 109*a* for covering an upper area of the first accommodating space 101*b*, and a second cap 109*b* for covering an upper area of the second accommodating space 101*c*.

The first cap 109*a* may be disposed above the first duct module 120. The first cap 109*a* may include a 1a-th cap hole 109*aa* disposed to correspond to 1a-th fan outlet 121*b* formed in a first fan case 121, and a 1b-th cap hole 109*ab* disposed to correspond to a 1b-th fan outlet 121*c* formed in the first fan case 121. The 1a-th cap hole 109*aa* may communicate with the first cool air duct 33. The 1b-th cap hole 109*ab* may communicate with the third cool air duct 35.

The second cap 109*b* may be disposed above the second duct module 130. The second cap 109*b* may include a second cap hole 109*ba* disposed to correspond to a second fan outlet 131*b* formed in a second fan case 131. The second cap hole 109*ba* may communicate with the second cool air duct.

In the accommodating spaces 101*b* and 101*c*, the duct modules 120 and 130 for moving cool air generated by the evaporator 111 to the storage chambers 20*a* and 20*b* may be disposed. The duct modules 120 and 130 may include the first duct module 120 disposed in the first accommodating space 101*b* and the second duct module 130 disposed in the second accommodating space 101*c*.

Specifically, referring to FIGS. 5 and 6, the first duct module 120 may include the first fan case 121, a first fan 122, the first fan cover 123, a first duct cover 124, and the separation cover 125.

The first fan case 121 may cover the first fan 122. The first fan case 121 may be detachably coupled to the first accommodating space 101*b*. The first fan case 121 may be fixed to the module body 101.

The first fan case 121 may include a first fan inlet 121*a* through which air heat-exchanged with the first evaporator 111*a* is introduced. The first fan inlet 121*a* may be formed in a rear side of the first fan case 121.

The first fan case 121 may include the 1a-th fan outlet 121*b* communicating with the first cool air duct 33. The 1a-th fan outlet 121*b* may discharge cool air to be supplied to the first storage chamber 20*a*. The 1a-th fan outlet 121*b* may be formed in a top side of the first fan case 121.

The first fan case 121 may include the 1b-th fan outlet 121*c* communicating with the third cool air duct 35. The 1b-th fan outlet 121*c* may discharge cool air to be supplied to the third storage chamber 20*bb*. The 1b-th fan outlet 121*c* may be formed in the top side of the first fan case 121.

The first fan case 121 may include the first fan connection opening 121*d* communicating with the connection duct 112. The first fan connection opening 121*d* may allow air blown by a second fan 132 to be introduced. The first fan connection opening 121*d* may allow cool air, to be supplied to the third storage chamber 20*bb*, to be introduced. The first fan connection port 121*d* may be formed in a lateral side of the first fan case 121.

The first fan case 121 may include a first fan circulation opening 121*e* communicating with the third circulation duct 38. The first fan circulation opening 121*e* may guide air that has cooled the third storage chamber 20*bb* to the second evaporator 111*b*. The first fan circulation opening 121*e* may discharge air introduced into the first duct module 120 through a first duct circulation opening 127 to the second accommodating space 101*c* in which the second evaporator 111*b* is disposed. The first fan circulation opening 121*e* may be formed in a side of the first fan case 121 facing the separation wall 101*d*.

The first fan 122 may be driven to supply air heat-exchanged with the first evaporator 111*a* to the first storage chamber 20*a*. The first fan 122 may be disposed in the first accommodating space 101*b*. The first fan 122 may be fixed to the separation cover 125.

The first fan cover 123 may be coupled to a front side of the first fan case 121. The separation cover 125 may be disposed between the first fan cover 123 and the first fan case 121. A separation rib 123*b* may be provided on a rear surface of the first fan cover 123 to partition a space between the separation cover 125 and the first fan cover 123. By the separation rib 123*b*, the space between the first fan cover 123 and the separation cover 125 may be partitioned into a space to which air is supplied from the connection duct 112 and a space to which air that has cooled the third storage chamber 20*bb* returns.

The separation cover 125 may cover the front side of the first fan case 121. The separation cover 125 may separate an inside space defined by the first fan case 121 and the first fan cover 123. The separation cover 125 may form a space through which cool air to be supplied to the first storage chamber 20*a* moves, together with the first fan case 121. The separation cover 125 may form a space through which cool air to be supplied to the third storage chamber 20*bb* moves, together with the first fan cover 123. Behind the separation cover 125, a passage through which air heat-exchanged with the first evaporator 111*a* moves may be formed, and in front of the separation cover 125, a passage through which air heat-exchanged with the second evaporator 111*b* moves may be formed. Also, behind the separation cover 125, a passage through which air moved by the first fan 122 flows may be formed, and in front of the separation cover 125, a passage through which air moved by the second fan 132 flows may be formed.

The separation cover 125 may prevent air heat-exchanged with the first evaporator 111*a* from being mixed with air heat-exchanged with the second evaporator 111*b*. The separation cover 125 may prevent air moved by the first fan 122 from being mixed with air moved by the second fan 132. The separation cover 125 may support the first fan 122.

The separation cover 125 may include a hole forming portion 125*a* that forms a hole communicating with the third cool air duct 35 when the separation cover 125 is coupled to the first fan cover 123. The hole forming portion 125*a* may be formed in an upper portion of the separation cover 125.

The separation cover 125 may be provided with a connection duct damper 114 for regulating an amount of cool air passing through the connection duct 112. Temperature of the third storage chamber 20*bb* may be regulated according to a degree of opening of the connection duct damper 114.

The first fan cover 123 may be disposed in front of the separation cover 125. The first fan cover 123 may form a space through which cool air to be supplied to the third storage chamber 20*bb* flows, together with the separation cover 125. The first fan cover 123 may be fixed to the first fan case 121.

The first fan cover 123 may include a first cover hole 123*a* communicating with the third storage chamber 20*bb*. The first cover hole 123*a* may discharge a part of air introduced through the connection duct 112 to the third storage chamber 20*bb*. A part of cool air introduced through the connection duct 112 may be transferred to the third cool air duct 35 and then supplied to the third storage chamber 20*bb*, and the other part of the cool air may be supplied to the third storage chamber 20*bb* through the first cover hole 123*a*.

The first duct cover 124 may be disposed in front of the first fan cover 123. The first duct cover 124 may cover a front side of the first fan cover 123. The first duct cover 124 may include a first duct hole 124*a* communicating with the third storage chamber 20*bb*. The first duct hole 124*a* may be disposed to correspond to the first cover hole 123*a*. A part of cool air blown by the second fan 132 may be supplied to the third storage chamber 20*bb* through the first cover hole 123*a* and the first duct hole 124*a*.

The first duct cover 124 may include a first duct inlet 124*b*. The first duct inlet 124*b* may be spaced a predetermined distance from the module body 101. The first duct inlet 124 may form the first duct circulation opening 127 together with the module body 101. Air that has cooled the third storage chamber 20*bb* through the first duct circulation opening 127 may return to the first duct module 120. The air returned through the first duct circulation opening 127 may be guided to the second evaporator 111*b* through the third circulation duct 38.

The second duct module 130 may include the second fan case 131, the second fan 132, a second fan cover 133, and a second duct cover 134.

The second fan case 131 may be disposed in the second accommodating space 101*c*. The second fan case 131 may include a second fan inlet 131*a* through which air heat-exchanged with the second evaporator 111*b* is introduced. The second fan inlet 131*a* may be formed in a rear side of the second fan case 131.

The second fan case 131 may include the second fan outlet 131*b* communicating with the second cool air duct 34. The second fan outlet 131*b* may discharge cool air to be supplied to the second storage chamber 20*ba*. The second fan outlet 131*b* may be formed in a top side of the second fan case 131.

The second fan case 131 may include the second fan connection opening 131*c* communicating with the connection duct 112. The second fan connection opening 131*c* may discharge air blown by the second fan 132 to the connection duct 112. The second fan connection opening 131*c* may discharge cool air to be supplied to the third storage chamber 20*bb*. The second fan connection opening 131*c* may be formed in a lateral side of the second fan case 131.

The second fan 132 may be driven to supply air heat-exchanged with the second evaporator 111*b* to the second storage chamber 20*ba* and the third storage chamber 20*bb*. The second fan 132 may be disposed in the second accommodating space 101*c*. The second fan 132 may be fixed to the second fan cover 133.

The second fan cover 133 may be coupled to the front side of the second fan case 131. The second fan cover 133 may cover the front side of the second fan case 131. The second fan cover 133 may form a space through which cool air to be supplied to the second storage chamber 20*ba* and the third storage chamber 20*bb* flows, together with the second fan case 131. The second fan cover 133 may be fixed to the second fan case 131.

The second fan cover 133 may include a second cover hole 133*a* communicating with the second storage chamber 20*ba*. The second cover hole 133*a* may discharge a part of air blown by the second fan 132 to the second storage chamber 20*ba*. A part of air blown by the second fan 132 may be transferred to the second cool air duct and then supplied to the second storage chamber 20*ba*, and the other part of the air may be supplied to the second storage chamber 20*ba* through the second cover hole 133*a*. The second fan cover 133 may support the second fan 132.

The second duct cover 134 may be disposed in front of the second fan cover 133. The second duct cover 134 may cover a front side of the second fan cover 133.

The second duct cover 134 may include a second duct hole 134*a* communicating with the second storage chamber 20*ba*. The second duct hole 134*a* may correspond to the second cover hole 133*a*. A part of cool air blown by the second fan 132 may be supplied to the second storage chamber 20*ba* through the second cover hole 133*a* and the second duct hole 134*a*.

The second duct cover 134 may include a second duct inlet 134*b*. The second duct inlet 134*b* may be spaced a predetermined distance from the module body 101. The second duct inlet 134*b* may form the second duct circulation opening 137 together with the module body 101. Air that has cooled the second storage chamber 20*ba* through the second duct circulation opening 137 may return to the second duct module 130. Air returned through the second duct circulation opening 137 may be guided to the second evaporator 111*b*.

A part of air that has cooled the third storage chamber 20*bb* may move to the second storage chamber 20*ba* through the second circulation duct 37. The second circulation duct 37 may penetrate the separation plate 18. The air that has moved to the second storage chamber 20*ba* by the second circulation duct 37 may return to the second accommodating space 101*c* together with the air that has cooled the second storage chamber 20*ba*.

According to the configuration as above, in the refrigerator 1 according to an embodiment of the disclosure, all components of the cool air supply system may be arranged in the cooling module 100, and the cooling module 100 may be detachably mounted to the cabinet 10, so that cooling performance of the cool air supply system may be tested before the cooling module 100 is mounted to the cabinet 10. In addition, because the cool air supply system may be separated from the cabinet 10 to be maintained and repaired, maintenance of the refrigerator 1 may be easy.

Figure 7:
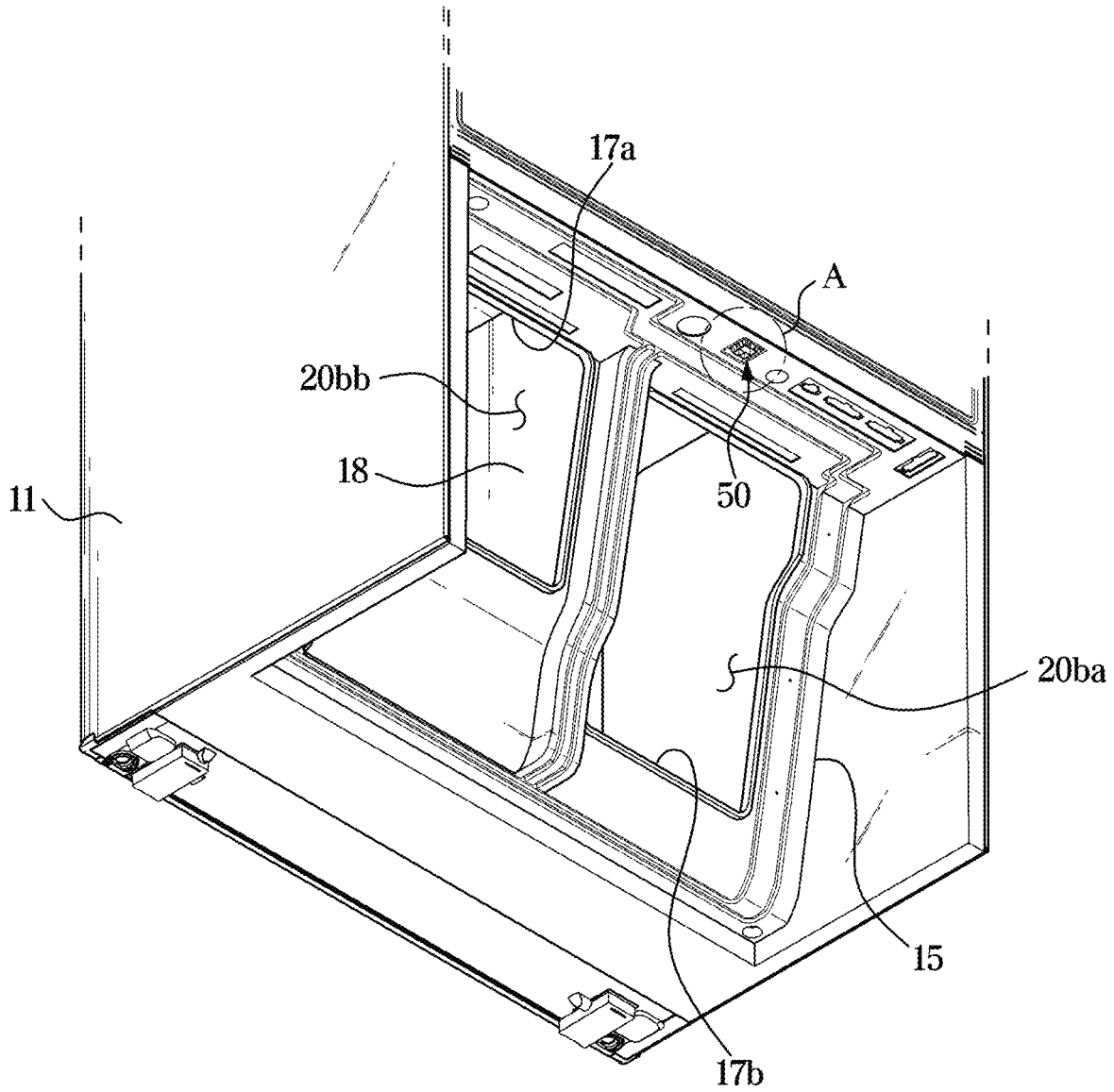
FIG. 7 illustrates a bottom perspective view of a cooling module mounting portion of the cabinet illustrated in FIG. 2.
Figure 8:
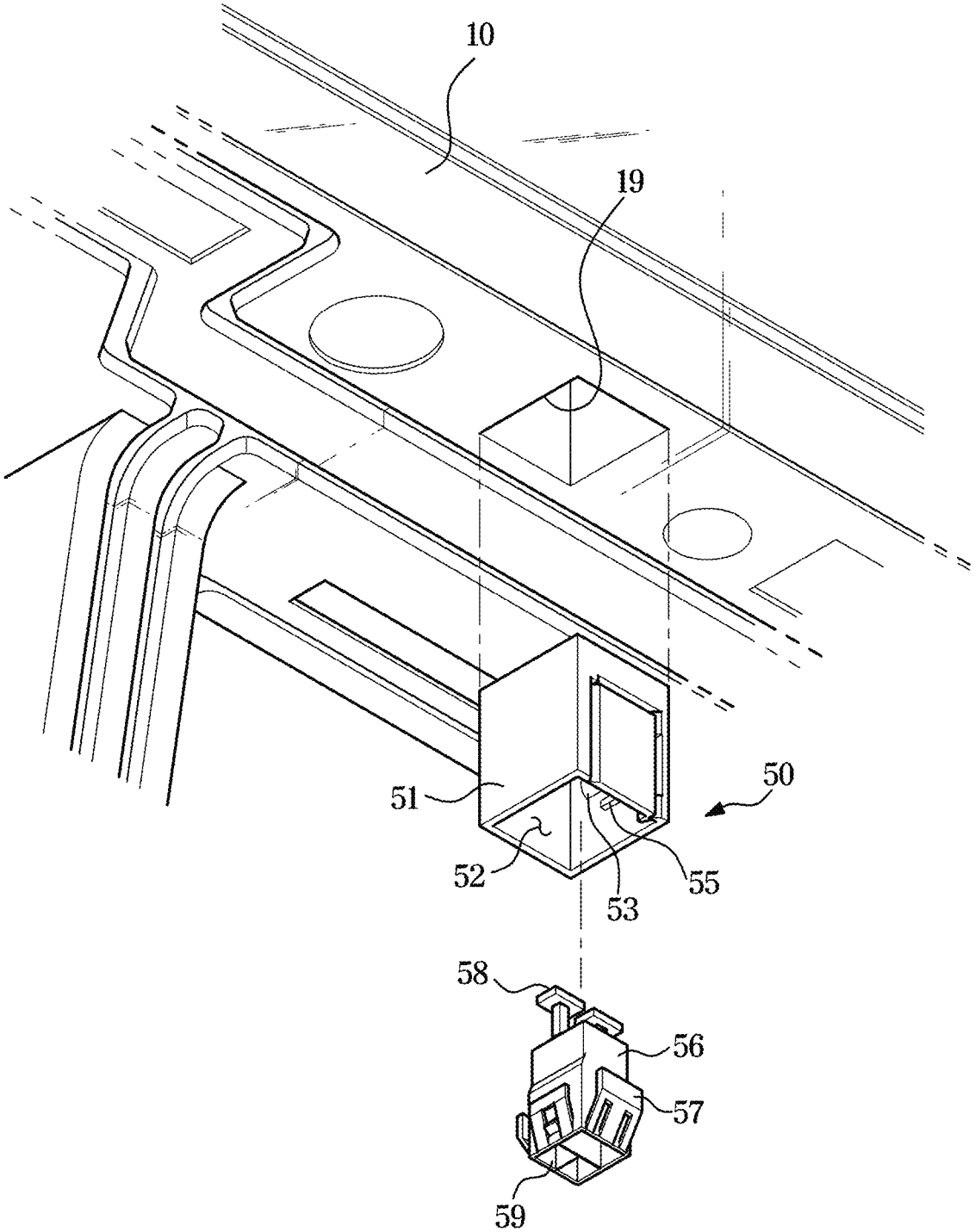
FIG. 8 illustrates an enlarged view of a portion A illustrated in FIG. 7, illustrating that a cabinet connection device is combined.
Figure 9:
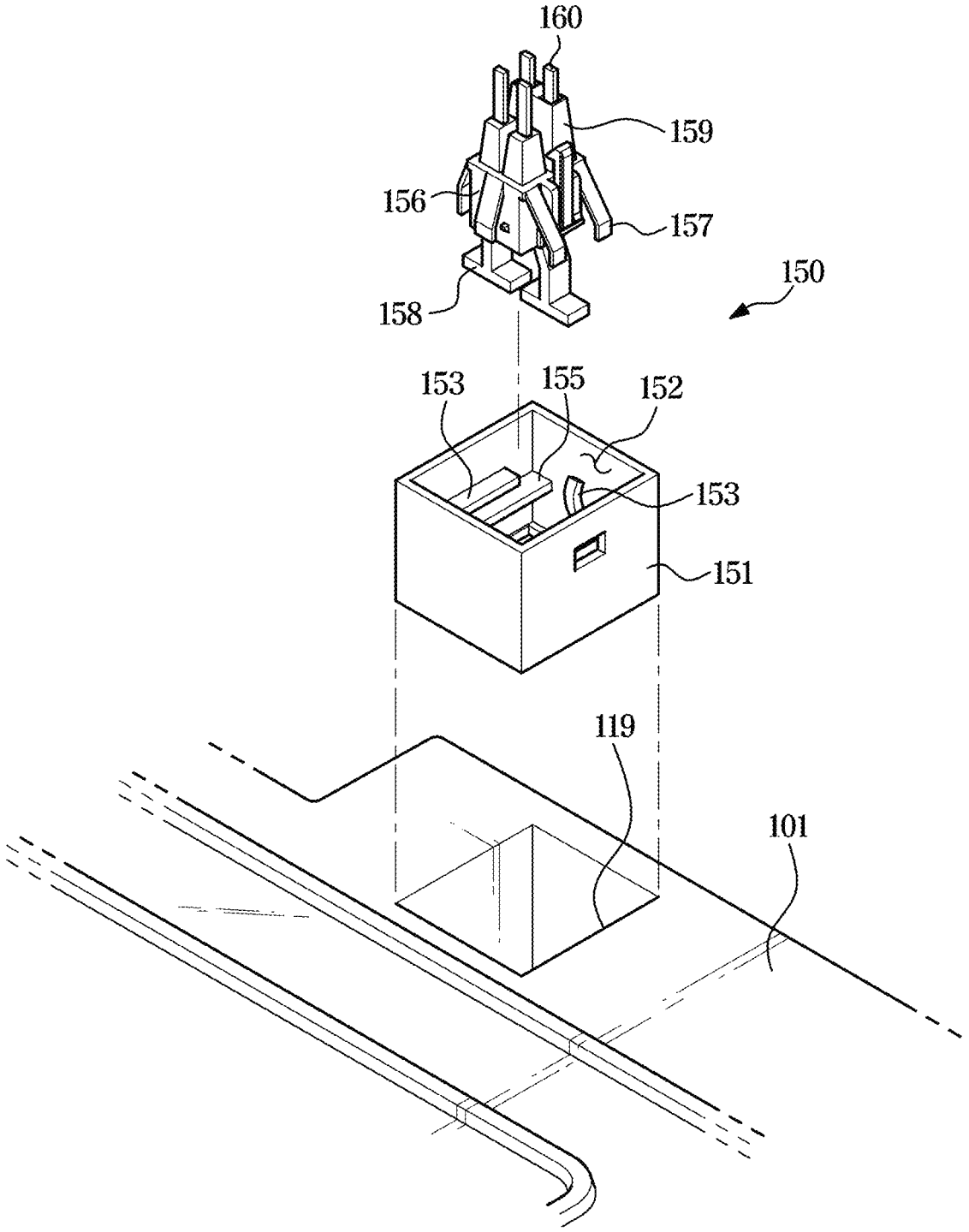
FIG. 9 illustrates an enlarged view of a portion B illustrated in FIG. 2, illustrating that a module connection device is combined.
Figure 10:
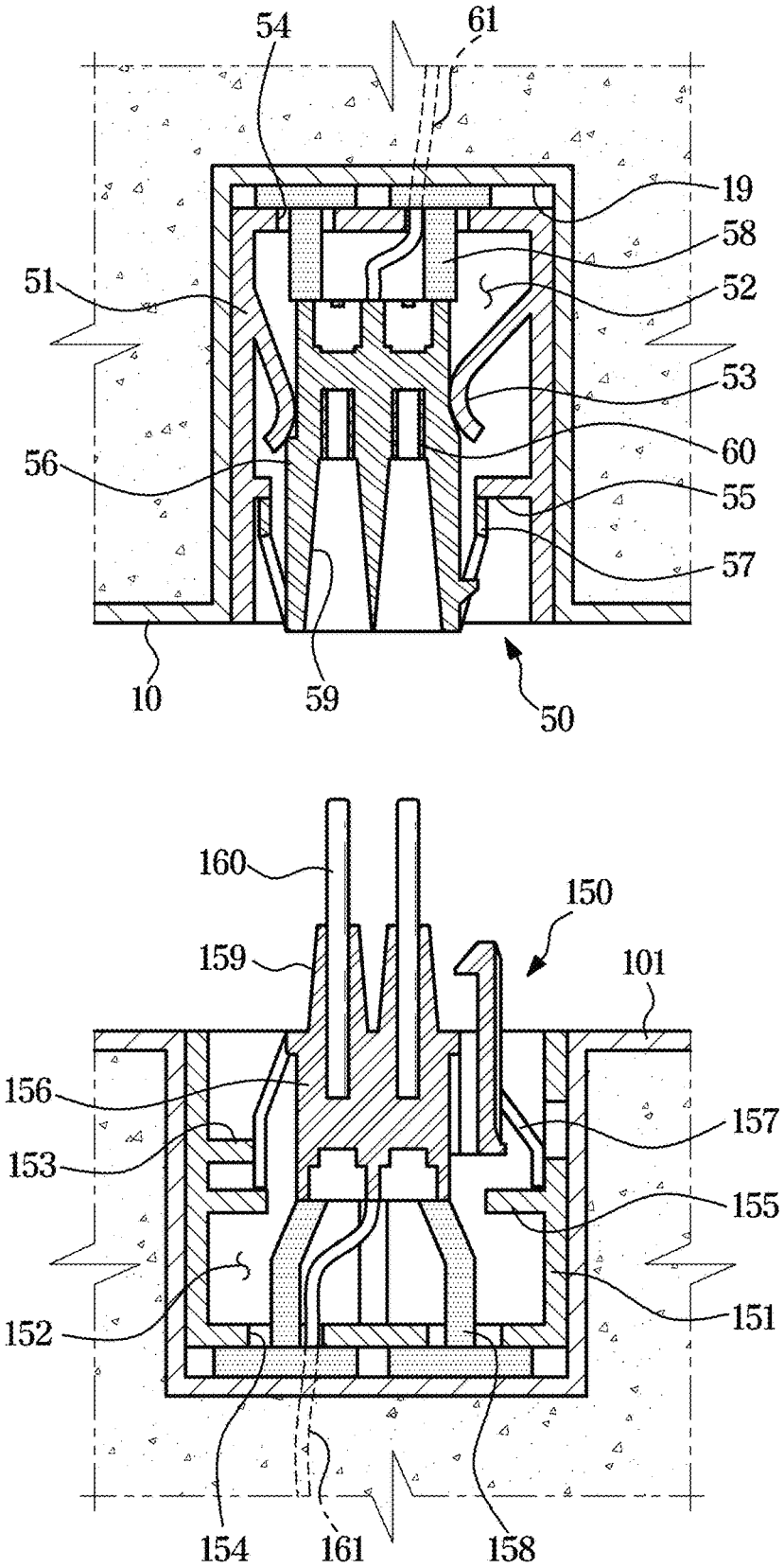
FIGS. 10 and 11 illustrate a process in which the cabinet connection device and the module connection device illustrated in FIG. 2 are coupled to each other.
Figure 11:
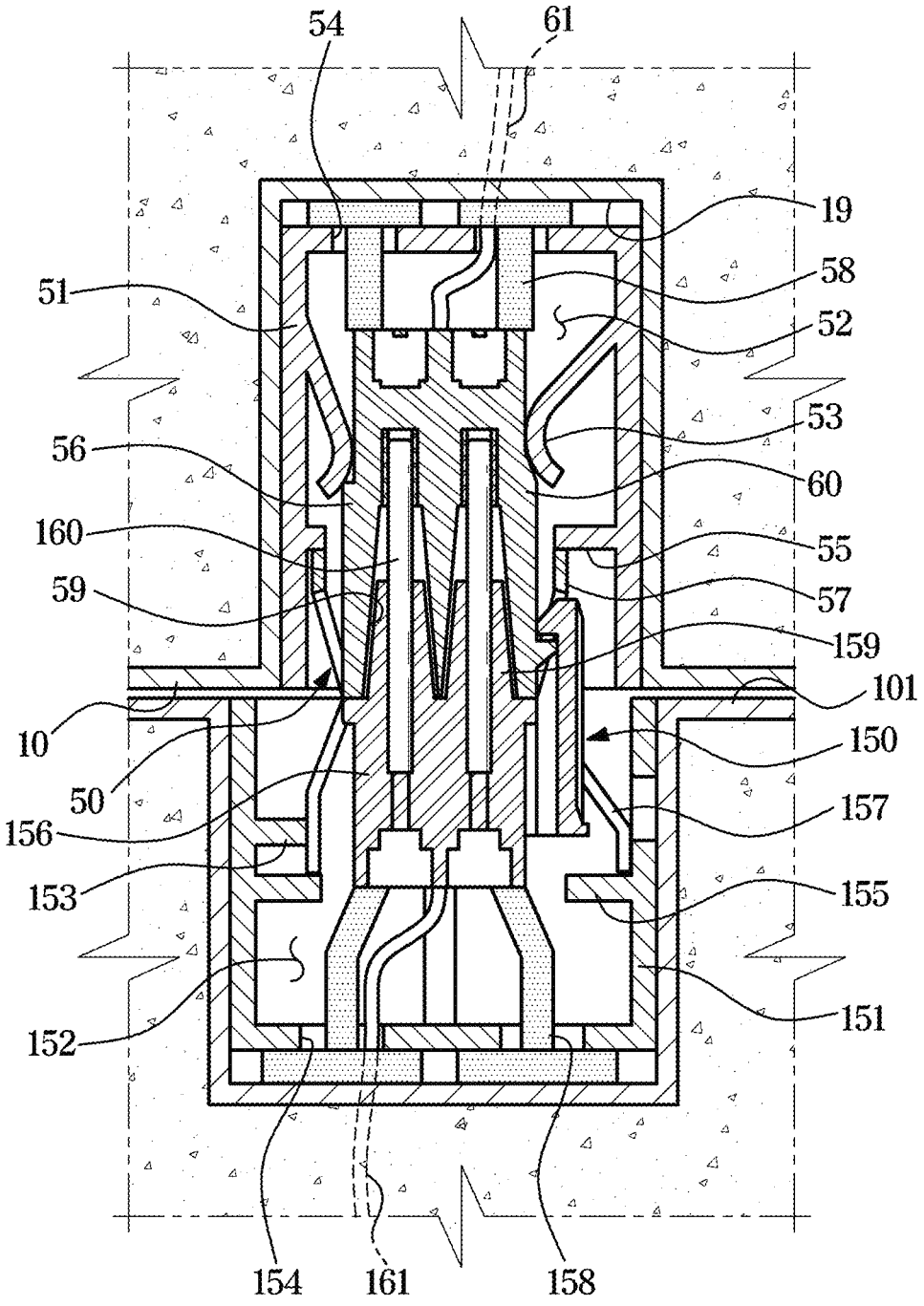
Figure 12:
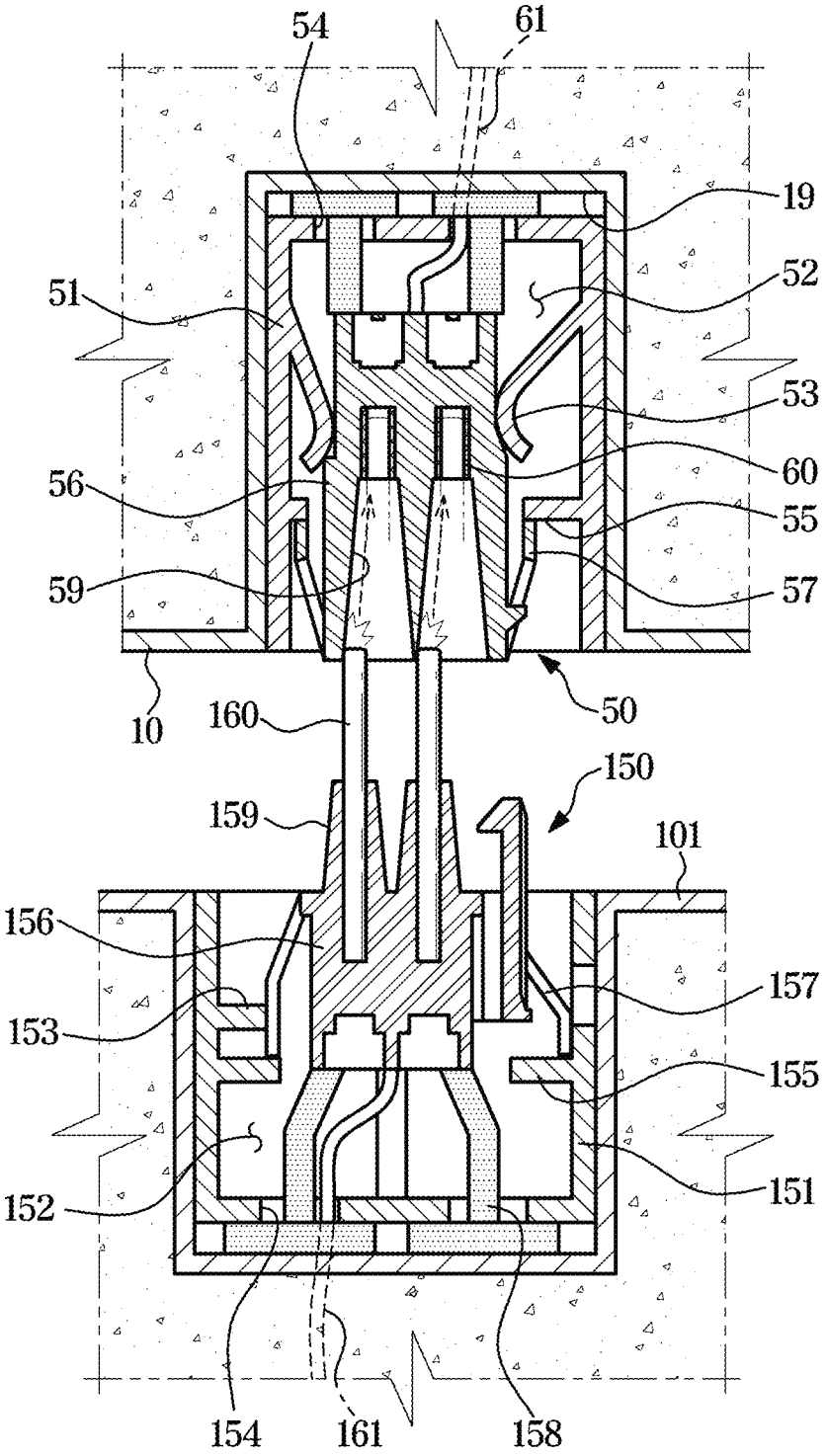
FIG. 12 illustrates a case in which the cabinet connection device and the module connection device illustrated in FIG. 2 are coupled in a misaligned position.

FIG. 7 illustrates a bottom perspective view of a cooling module mounting portion of the cabinet illustrated in FIG. 2, FIG. 8 illustrates an enlarged view of a portion A illustrated in FIG. 7, illustrating that a cabinet connection device is combined, FIG. 9 illustrates an enlarged view of a portion B illustrated in FIG. 2, illustrating that a module connection device is combined, FIGS. 10 and 11 illustrate a process in which the cabinet connection device and the module connection device illustrated in FIG. 2 are coupled to each other, and FIG. 12 illustrates a case in which the cabinet connection device and the module connection device illustrated in FIG. 2 are coupled in a misaligned position.

Referring to FIGS. 2 and 7, the cooling module 100 may be electrically connected to the cabinet 10. To this end, the cooling module 100 includes a module connection device 150, and the cabinet 10 includes a cabinet connection device 50.

Referring to FIGS. 7, 8 and 10, the cabinet connection device 50 may be mounted to the cabinet 10. A cabinet accommodating portion 19 to which the cabinet connection device 50 is inserted and fixed may be formed in the cabinet 10. The cabinet accommodating portion 19 may be disposed in the cooling module mounting portion 15. A cabinet wire 61 connected to the electronic device 40 disposed in the cabinet 10 may extend to the cabinet accommodating portion 19 and may be electrically connected to a cabinet connector 56.

The cabinet connection device 50 may be inserted into and fixed to the cabinet accommodating portion 19 of the cabinet 10. The cabinet connection device 50 may include a cabinet fixing member 51 and the cabinet connector 56 inserted into and fixed to the cabinet fixing member 51.

The cabinet fixing member 51 may be provided in a size and shape corresponding to the cabinet accommodating portion 19. The cabinet fixing member 51 may accommodate the cabinet connector 56. The cabinet fixing member 51 may include a cabinet connector accommodating space 52 in which the cabinet connector 56 is mounted.

The cabinet fixing member 51 may include a cabinet buffer member 53 to elastically support the cabinet connector 56 mounted therein. The cabinet buffer member 53 may elastically support a lateral side of the cabinet connector 56. The cabinet buffer member 53 may elastically support a lateral movement of the cabinet connector 56 inside the cabinet fixing member 51. The cabinet buffer member 53 may protrude from an inner surface of the cabinet fixing member 51. The cabinet buffer member 53 may include a material having elasticity. The cabinet buffer member 53 may include rubber and/or silicone.

Although FIG. 10 illustrates that the cabinet buffer member 53 is formed integrally with the cabinet fixing member 51, the present disclosure is not limited thereto, and the cabinet buffer member 53 may be provided separately from the cabinet fixing member 51.

The cabinet fixing member 51 may include a cabinet fixing opening 54 for fixing the cabinet connector 56. The cabinet fixing opening 54 may penetrate one surface of the cabinet fixing member 51. The cabinet fixing opening 54 may be formed on the other surface opposite to one surface of the cabinet fixing member 51 coupled to the cabinet connector 56. A cabinet leg 58 of the cabinet connector 56 may be inserted into and fixed to the cabinet fixing opening 54.

The cabinet wire 61 connected to the electronic device 40 disposed in the cabinet 10 may extend to the cabinet connector accommodating space 52 of the cabinet fixing member 51 through the cabinet fixing opening 54 to be electrically connected to the cabinet connector 56.

The cabinet fixing member 51 may include a cabinet fixing protrusion 55. The cabinet fixing protrusion 55 may protrude from the inner surface of the cabinet fixing member 51. The cabinet fixing protrusion 55 may support a cabinet connector protrusion 57 of the cabinet connector 56. The cabinet fixing protrusion 55 may support the movement of the cabinet connector 56 according to a direction of being coupled to a module connector 156.

When the cabinet leg 58 is inserted into and supported on the cabinet fixing opening 54 and the cabinet connector protrusion 57 is supported by the cabinet fixing protrusion 55, the cabinet connector 56 may be fixed to the cabinet fixing member 51.

The cabinet connector 56 may be electrically connected to the cabinet wire 61. The cabinet connector 56 may be electrically connected by being coupled to the module connector 156 of the cooling module 100.

The cabinet connector 56 may include the cabinet connector protrusion 57 protruding from an outer surface thereof. The cabinet connector protrusion 57 may be supported by the cabinet fixing protrusion 55 of the cabinet fixing member 51. The cabinet connector protrusion 57 may include a material having elasticity. The cabinet connector protrusion 57 may buffer an impact according to a direction in which the cabinet connector 56 is coupled to the module connector 156 when the cabinet connector 56 is coupled to the module connector 156.

The cabinet connector 56 may include the cabinet leg 58 inserted into and fixed to the cabinet fixing opening 54 of the cabinet fixing member 51. The cabinet leg 58 may extend to the other side opposite to one side of the cabinet connector 56 coupled to the module connector 156. The cabinet leg 58 may fix the cabinet connector 56 in position within the cabinet fixing member 51 together with the cabinet connector protrusion 57.

The cabinet connector 56 may include a cabinet guide 59. The cabinet guide 59 may guide the coupling of the module connector 156 when the module connector 156 is coupled to the cabinet connector 56. A width of the cabinet guide 59 may be narrowed in a direction to which the module connector 156 is coupled. The width of the cabinet guide 59 may increase in a direction away from a cabinet terminal 60. The cabinet guide 59 may be formed such that a module guide 159 of the module connector 156 may be inserted therein. The cabinet guide 59 may be formed in a groove shape.

The cabinet terminal 60 may be disposed in the cabinet connector 56. The cabinet terminal 60 may be disposed inside the cabinet guide 59. The cabinet terminal 60 is electrically connected to the cabinet wire 61.

Referring to FIGS. 2, 9 and 10, the module connection device 150 may be mounted to the module body 101 of the cooling module 100. A module accommodating space 119 into which the module connection device 150 is inserted and fixed may be formed in the module body 101. The module accommodating space 119 may be formed on a top surface of the module body 101. The module accommodating space 119 may be disposed to correspond to the cabinet accommodating portion 19 of the cabinet 10 when the cooling module 100 is mounted to the cabinet 10. A module wire 161 connected to the electronic equipment box 140 disposed in the cooling module 100 may extend to the module accommodating space 119. The module wire 161 may be electrically connected to the cool air supply system.

The module connection device 150 may be inserted into and fixed to the module accommodating space 119 of the module body 101. The module connection device 150 may include a module fixing member 151 and the module connector 156 inserted into and fixed to the module fixing member 151.

The module fixing member 151 may be formed in a size and shape corresponding to the module accommodating space 119. The module fixing member 151 may accommodate the module connector 156. The module fixing member 151 may include a module connector accommodating space 152 in which the module connector 156 is mounted.

The module fixing member 151 may include a module buffer member 153 to elastically support the module connector 156 mounted therein. The module buffer member 153 may elastically support a side surface of the module connector 156. The module buffer member 153 may elastically support a lateral movement of the module connector 156 inside the module fixing member 151. The module buffer member 153 may protrude from an inner surface of the module fixing member 151. The module buffer member 153 may include a material having elasticity. The module buffer member 153 may include rubber and/or silicone.

Although FIG. 10 illustrates that the module buffer member 153 is formed integrally with the module fixing member 151, the present disclosure is not limited thereto, and the module buffer member 153 may be provided separately from the module fixing member 151.

The module fixing member 151 may include a module fixing opening 154 for fixing the module connector 156. The module fixing opening 154 may penetrate one surface of the module fixing member 151. The module fixing opening 154 may be formed on the other surface opposite to one surface of the module fixing member 151 coupled to the module connector 156. A module leg 158 of the module connector 156 may be inserted into and fixed to the module fixing opening 154.

The module wire 161 connected to the electronic equipment box 140 disposed in the cooling module 100 may be electrically connected to the module connector 156 through the module fixing opening 154.

The module fixing member 151 may include a module fixing protrusion 155. The module fixing protrusion 155 may protrude from the inner surface of the module fixing member 151. The module fixing protrusion 155 may support a module connector protrusion 157 of the module connector 156.

When the module leg 158 is inserted into and supported on the module fixing opening 154 and the module connector protrusion 157 is supported by the module fixing protrusion 155, the module connector 156 may be fixed to the module fixing member 151.

The module connector 156 may be electrically connected to the module wire 161. The module connector 156 may be electrically connected by being coupled to the cabinet connector 56 disposed in the cabinet 10.

The module connector 156 may include the module connector protrusion 157 protruding from an outer surface thereof. The module connector protrusion 157 may be supported by the module fixing protrusion 155 of the module fixing member 151. The module connector protrusion 157 may include a material having elasticity. The module connector protrusion 157 may buffer an impact according to a direction in which the module connector 156 is coupled to the cabinet connector 56 when the module connector 156 is coupled to the cabinet connector 56.

The module connector 156 may include the module leg 158 inserted into and fixed to the module fixing opening 154 of the module fixing member 151. The module leg 158 may extend to the other side opposite to one side of the module connector 156 coupled to the cabinet connector 56. The module leg 158 may fix the module connector 156 in position within the module fixing member 151 together with the module connector protrusion 157.

The module connector 156 may include a module guide 159. The module guide 159 may guide the coupling of the module connector 156 when the cabinet connector 56 is coupled to the module connector 156. A width of the module guide 159 may be narrowed in a direction to which the module connector 156 is coupled.

A module terminal 160 may be disposed in the module connector 156. The module terminal 160 may protrude from an end of the module guide 159. The module terminal 160 is electrically connected to the module wire 161.

Referring to FIGS. 10 to 12, according to the configuration as above, in the coupling of the cabinet connection device 50 and the module connection device 150, even when the cabinet connection device 50 and the module connection device 150 are coupled in a misaligned position, by the interaction of the components for buffer support of the cabinet connector 56 inside the cabinet fixing member 51, the components for buffer support of the module connector 156 inside the module fixing member 151, and the components for guiding the coupling of the cabinet connection device 50 and the module connection device 150, the cabinet connection device 50 and the module connection device 150 may be coupled to each other by being guided to a correct position.

In addition, the cabinet connection device 50 according to an embodiment of the disclosure is fixed to the cabinet 10 and the module connection device 150 is fixed to the cooling module 100, so that the cabinet connection device 50 and the module connection device 150 may be coupled to each other without additional work when the cooling module 100 is coupled to the cabinet 10, thereby electrically connecting the cooling module 100 to the cabinet 10.

Figure 13:
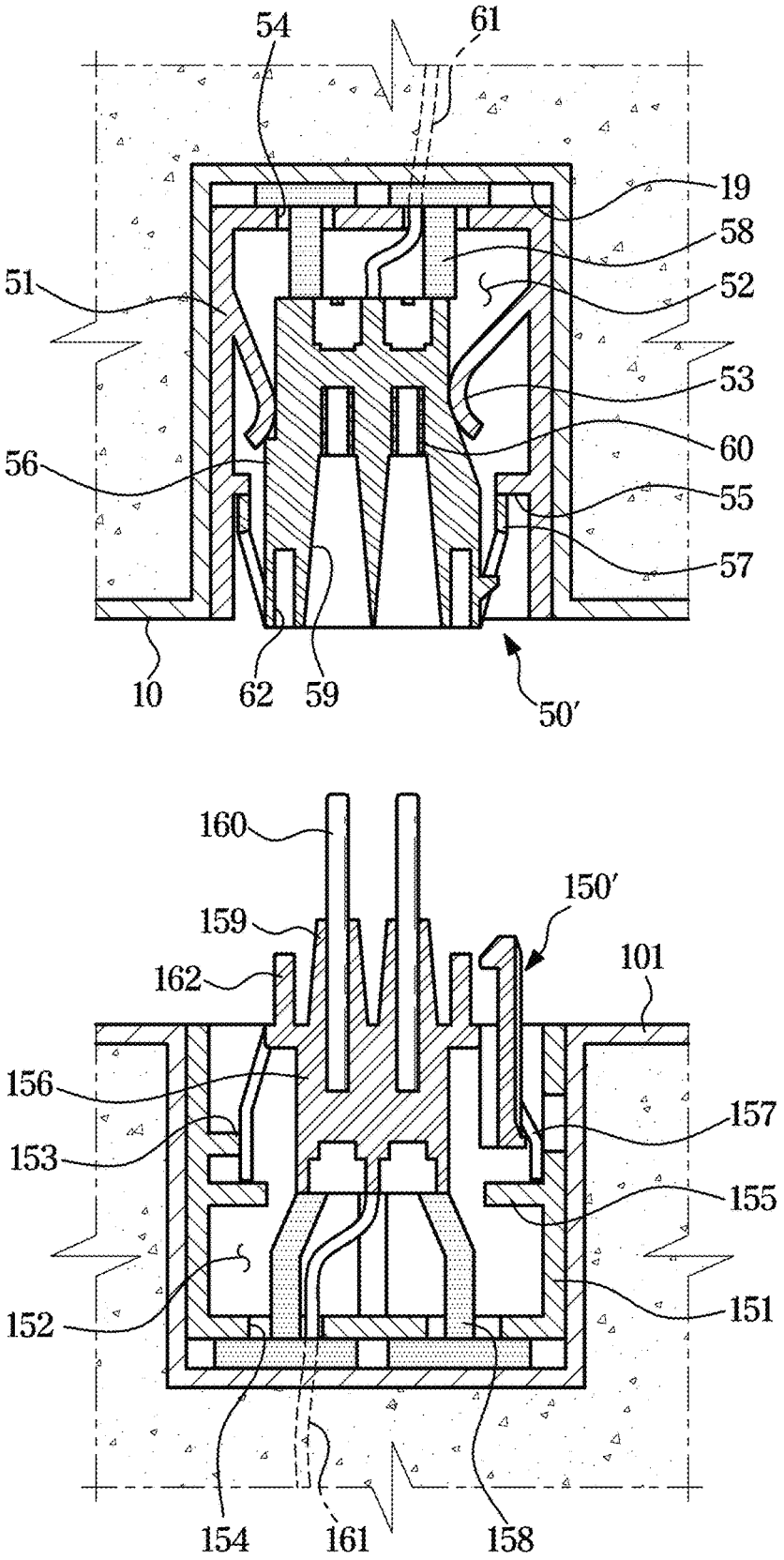
FIGS. 13 and 14 illustrate a process in which a cabinet connection device and a module connection device according to another embodiment are coupled to each other.
Figure 14:
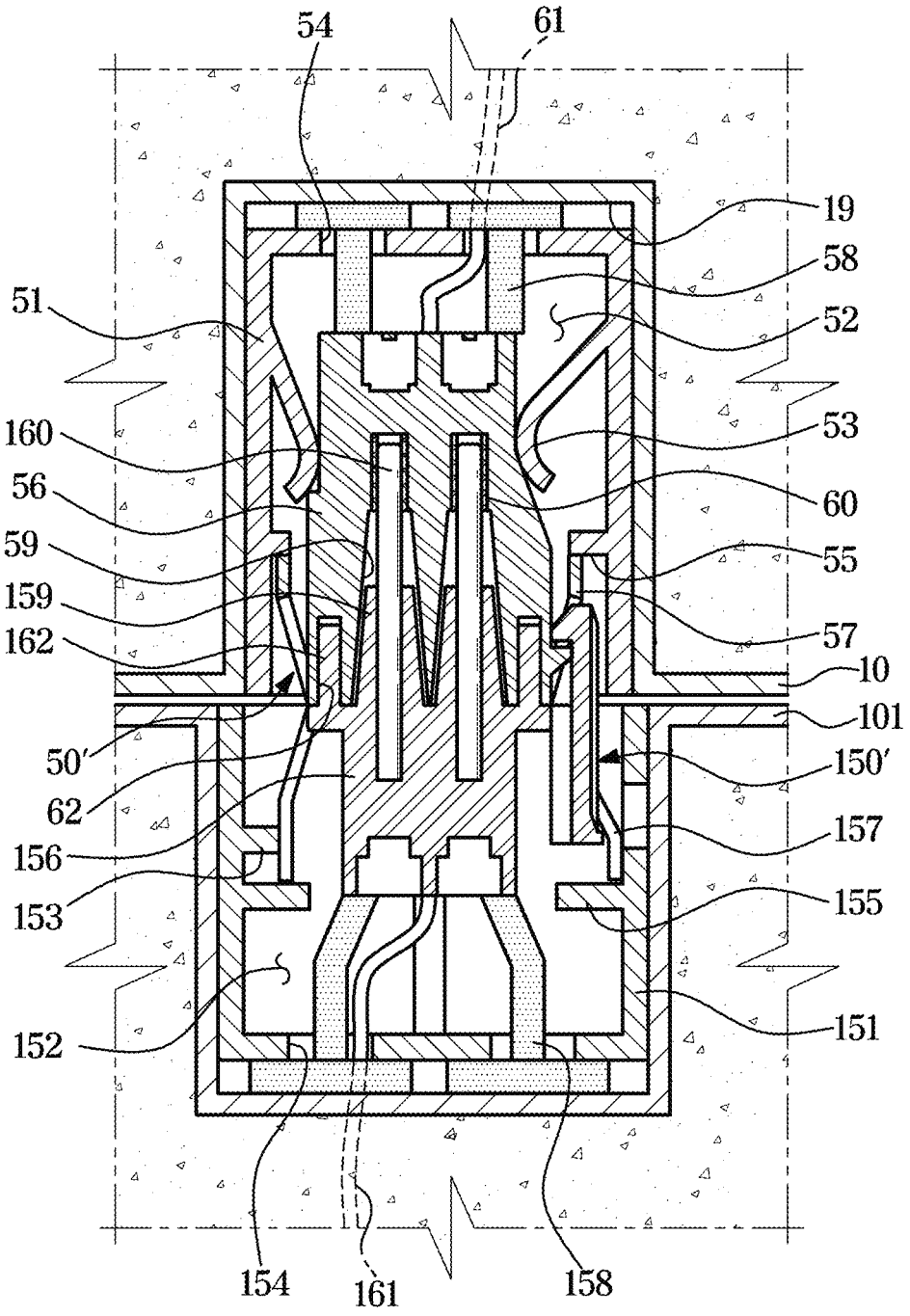

FIGS. 13 and 14 illustrate a process in which a cabinet connection device and a module connection device according to another embodiment are coupled to each other.

Hereinafter, a cabinet connection device 50' and a module connection device 150 according to another embodiment of the disclosure will be described with reference to FIGS. 13 and 14. A detailed description of the same configuration as that described in the previous embodiment may be omitted.

Referring to FIGS. 13 and 14, the cabinet connection device 50' may include a cabinet aligning portion 62, and the module connection device 150' may include a module aligning portion 162. The cabinet aligning portion 62 and the module aligning portion 162 may be coupled to each other. The cabinet aligning portion 62 and the module aligning portion 162 may guide the cabinet connection device 50' and the module connection device 150', respectively, so that the module connection device 150' may be coupled in position with respect to the cabinet connection device 50'.

Although FIGS. 13 and 14 illustrate that the cabinet aligning portion 62 is formed in a groove shape and the module aligning portion 162 is formed in a protrusion shape, the cabinet aligning portion 62 may be formed in a protrusion shape and the module aligning portion 162 may be formed in a groove shape.

Also, although FIGS. 13 and 14 illustrate that the cabinet aligning portion 62 is disposed adjacent to the cabinet guide 59 and the module aligning portion 162 is disposed adjacent to the module guide 159, the positions of the cabinet aligning portion 62 and the module aligning portion 162 are not limited thereto, and the cabinet aligning portion 62 and the module aligning portion 162 may be disposed at any position as long as the cabinet aligning portion 62 and the module aligning portion 162 may guide the coupling of the cabinet connection device 50' and the module connection device 150'.

As the cabinet aligning portion 62 and the module aligning portion 162 are additionally provided, the cabinet connection device 50' and the module connection device 150' may be more stably coupled to each other in position.

Figure 15:
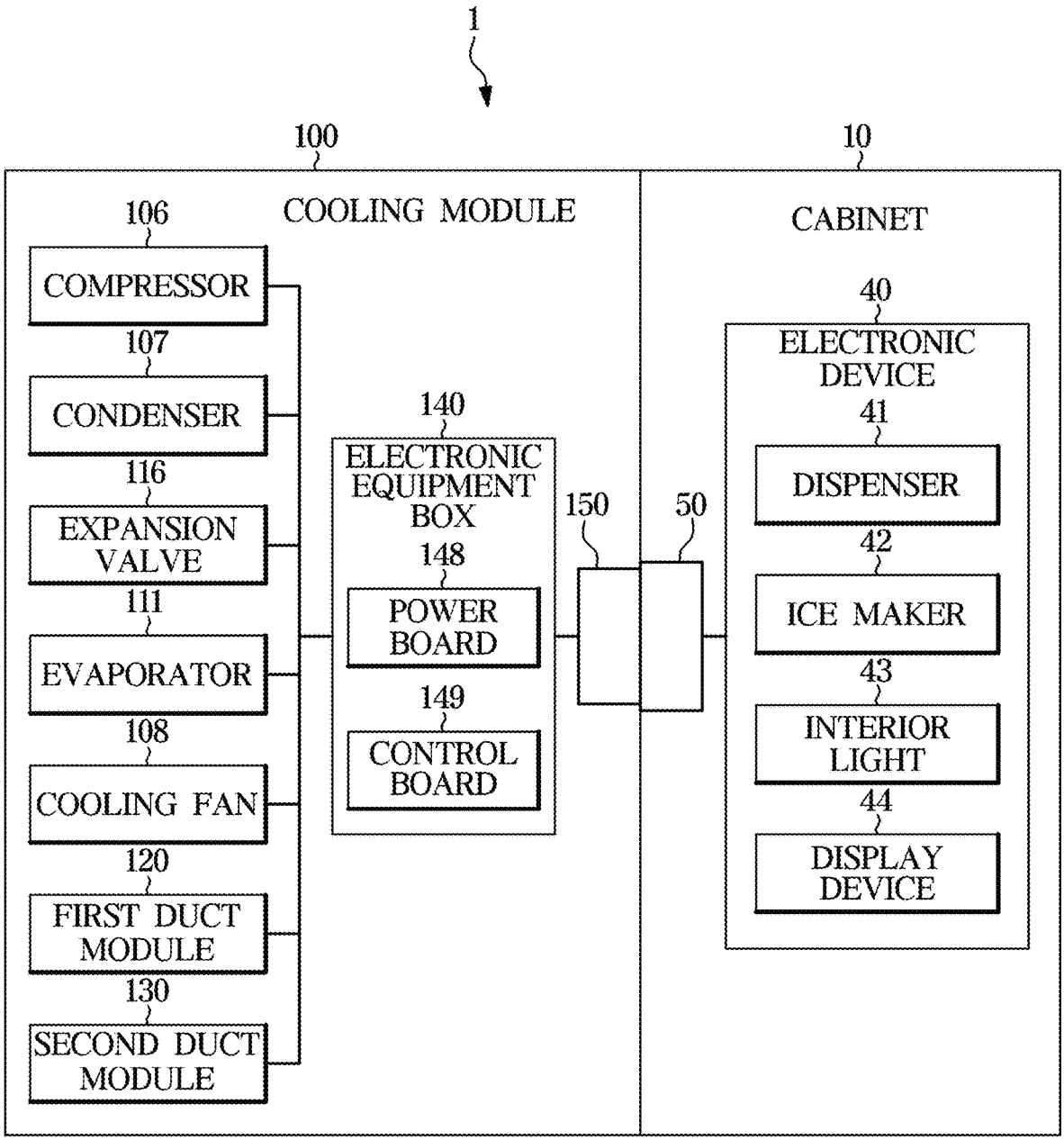
FIG. 15 schematically illustrates an electrical connection relationship between an electronic device disposed in the cabinet and electrical components disposed in the cooling module which are illustrated in FIG. 2.

FIG. 15 schematically illustrates an electrical connection relationship between an electronic device disposed in the cabinet and electrical components disposed in the cooling module which are illustrated in FIG.

Hereinafter, an electrical connection relationship between the electronic device 40 disposed in the cabinet 10 of the refrigerator 1 and electrical components disposed in the cooling module 100 according to an embodiment of the disclosure will be described with reference to FIG. 15.

Referring to FIG. 15, the electronic equipment box 140 may be disposed in the cooling module 100. In cooling module 100, the compressor 106, the condenser 107, the expansion valve 116, the evaporator 111, the cooling fan 108, the first duct module 120 and the second duct module 130 may be disposed. The compressor 106, the condenser 107, the expansion valve 116, the evaporator 111, the cooling fan 108, the first duct module 120 and the second duct module 130 which are disposed in cooling module 100 may be referred to as electrical components.

The electronic device 40 to be operated by being supplied with power may be disposed in the cabinet 10. The electronic device 40 may include at least one of a dispenser 41, an ice maker 42, an interior light 43, and a display device 44.

The electronic equipment box 140 may include a power board 148 to be supplied with power from an outside and to be delivered the power to the electrical components disposed in the cooling module 100 and/or the electronic device 40 disposed in the cabinet 10, and a control board 149 to be supplied with power from the power board 148 and to control the electrical components disposed in the cooling module 100 and/or the electronic device 40 disposed in the cabinet 10.

The electronic equipment box 140 may be electrically connected to the compressor 106, the condenser 107, the expansion valve 116, and the evaporator 111 to supply power to the cool air supply system or to control the cooling air supply system to regulate a flow rate of a refrigerant.

The electronic equipment box 140 may be electrically connected to the cooling fan 108 to supply power to the cooling fan 108 or to control a rotation speed of the cooling fan 108 such that heat in the machine room S may be effectively released.

The electronic equipment box 140 may be electrically connected to the first duct module 120 and/or the second duct module 130 to supply power to the first duct module 120 and/or the second duct module 130, or to control a rotation speed of the first fan 122 of the first duct module 120 and/or a rotation speed of the second fan 132 of the second duct module 130 to regulate an amount of cool air to be supplied to the storage chambers 20*a* and 20*b*. Accordingly, temperature of the storage chambers 20*a* and 20*b* may be regulated.

The dispenser 41 may be disposed on the upper door 21*a* of the refrigerator 1. The electronic equipment box 140 may be electrically connected to the dispenser 41 to supply power to the dispenser 41 or to control the dispenser 41.

The ice maker 42 may be disposed in the upper storage chamber 20*a*. The electronic equipment box 140 may be electrically connected to the ice maker 42 to supply power to the ice maker 42 or to control the ice maker 42.

The interior light 43 may be disposed in the storage chambers 20*a* and 20*b*. The electronic equipment box 140 may be electrically connected to the interior light 43 to supply power to the interior light 43 or to turn the interior light 43 on or off.

The display device 44 may be disposed on the upper door 21*a*. The electronic equipment box 140 may be electrically connected to the display device 44 to supply power to the display device 44 or to control the display device 44.

According to the configuration as above, the electronic equipment box 140 may be electrically connected to the module connection device 150 and may be electrically connected to the cabinet electronic device 40 through the cabinet connection device 50 connected to the module connection device 150. The cabinet electronic device 40 may be electrically connected to the cabinet connection device 50 and may be supplied with power or receive a control command through the module connection device 150 connected to the cabinet connection device 50.

Figure 16:
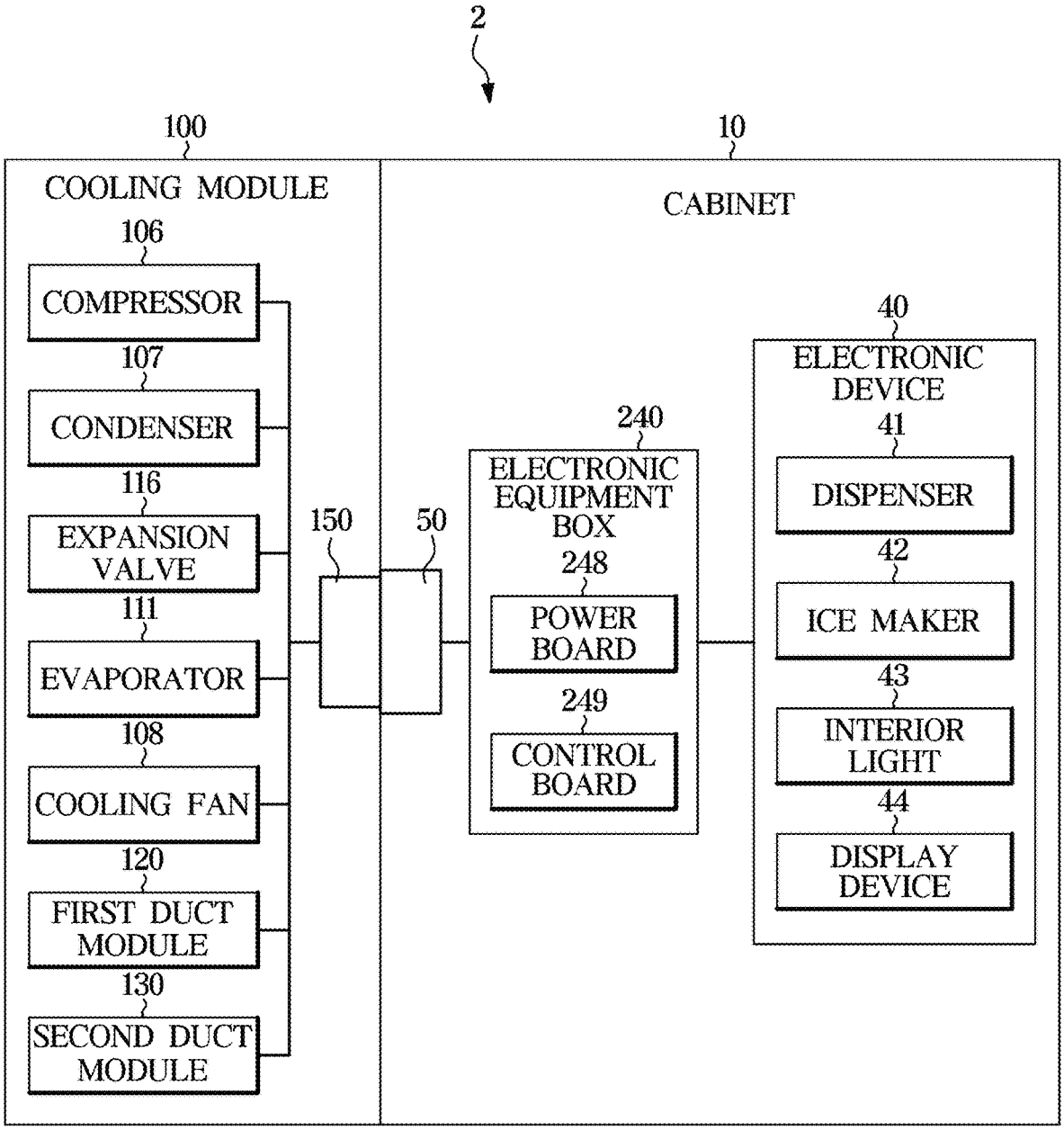
FIG. 16 schematically illustrates an electrical connection relationship between an electronic device disposed in a cabinet and electrical components disposed in a cooling module according to another embodiment.

FIG. 16 schematically illustrates an electrical connection relationship between an electronic device disposed in a cabinet and electrical components disposed in a cooling module according to another embodiment.

Hereinafter, an electrical connection relationship between the electronic device 40 disposed in the cabinet 10 of a refrigerator 2 and electrical components disposed in the cooling module 100 according to another embodiment of the disclosure will be described with reference to FIG. 16.

Referring to FIG. 16, an electronic equipment box 240 may be disposed in the cabinet 10. The electronic equipment box 240 disposed in the cabinet 10 may be electrically connected to the cabinet connection device 50. The cabinet connection device 50 and the module connection device 150 may be electrically connected. Accordingly, the electronic equipment box 240 disposed in the cabinet 10 may supply power to or control the electrical components disposed in the cooling module 100.

Specifically, the compressor 106, the condenser 107, the expansion valve 116, the evaporator 111, the cooling fan 108, the first duct module 120, and the second duct module 130 may be disposed in the cooling module 100.

The electronic device 40 and the electronic equipment box 240 to be operated by being supplied with power may be disposed in the cabinet 10. The electronic device 40 may include at least one of the dispenser 41, the ice maker 42, the interior light 43, and the display device 44.

The electronic equipment box 240 may include a power board 248 to be supplied with power from an outside and to be delivered the power to the electrical components disposed in the cooling module 100 and/or the electronic device 40 disposed in the cabinet 10, and a control board 249 to be supplied with power from the power board 248 and to control the electrical components disposed in the cooling module 100 and/or the electronic device 40 disposed in the cabinet 10.

The electronic equipment box 240 may be electrically connected to the compressor 106, the condenser 107, the expansion valve 116, and the evaporator 111 to supply power to the cool air supply system or to control the cooling air supply system to regulate a flow rate of a refrigerant.

The electronic equipment box 240 may be electrically connected to the cooling fan 108 to supply power to the cooling fan 108 or to control a rotation speed of the cooling fan 108 such that heat in the machine room S may be effectively released.

The electronic equipment box 240 may be electrically connected to the first duct module 120 and/or the second duct module 130 to supply power to the first duct module 120 and/or the second duct module 130, or to control a rotation speed of the first fan 122 of the first duct module 120 and/or a rotation speed of the second fan 132 of the second duct module 130 to regulate an amount of cool air to be supplied to the storage chambers 20*a* and 20*b*. Accordingly, temperature of the storage chambers 20*a* and 20*b* may be regulated.

The electronic equipment box 240 may be electrically connected to the dispenser 41 to supply power to the dispenser 41 or to control the dispenser 41. The electronic equipment box 240 may be electrically connected to the ice maker 42 to supply power to the ice maker 42 or to control the ice maker 42. The electronic equipment box 240 may be electrically connected to the interior light 43 to supply power to the interior light 43 or to turn the interior light 43 on or off. The electronic equipment box 240 may be electrically connected to the display device 44 to supply power to the display device 44 or to control the display device 44.

According to the configuration as above, the electronic equipment box 240 may be electrically connected to the cabinet connection device 50 and may be electrically connected to the electrical components disposed in the cooling module 100 through the module connection device 150 connected to the cabinet connection device 50. The electrical components disposed in the cooling module 100 may be electrically connected to the module connection device 150, and may be supplied with power or receive a control command through the cabinet connection device 50 connected to the module connection device 150.

As is apparent from the above, according to a refrigerator of the disclosure, because an evaporator is mounted in a cooling module detachably mounted to a cabinet together with a compressor and a condenser, a cool air supply system may be easily maintained.

According to the refrigerator of the disclosure, because a cabinet connector is fixed to the cabinet by a cabinet fixing member and a module connector is fixed to the cooling module by a module fixing member, the cooling module may be easily electrically connected to the cabinet, thereby enhancing productivity by improving the manufacturing process.

Although the present disclosure has been described with various embodiments, various changes and modifications may be suggested to one skilled in the art. It is intended that the present disclosure encompass such changes and modifications as fall within the scope of the appended claims.

What is claimed is:

1. A refrigerator comprising:

a cabinet in which an electronic device is disposed;

a cooling module provided with a cooling air supply system and detachably mounted on an outer side of the cabinet;

a cabinet connection device electrically connected to the electronic device and comprising:

a cabinet fixing member fixed to the cabinet, and a cabinet connector bufferably mounted to the cabinet fixing member; and a module connection device electrically connected to the cooling air supply system and comprising:

a module fixing member fixed to the cooling module, and a module connector bufferably mounted to the module fixing member for coupling to the cabinet connector.

2. The refrigerator according to claim 1, wherein the cabinet connection device further comprises a cabinet buffer member disposed between the cabinet fixing member and the cabinet connector, the cabinet buffer member comprised of a material having elasticity.

3. The refrigerator according to claim 1, wherein the cabinet connection device further comprises a cabinet guide configured to guide movement of the module connection device in a coupling direction when the cabinet connection device is coupled to the module connection device.

4. The refrigerator according to claim 3, wherein:

the cabinet connection device further comprises a cabinet aligning portion disposed adjacent to the cabinet guide and configured to guide the movement of the module connection device in the coupling direction together with the cabinet guide when the cabinet connection device is coupled to the module connection device, and the module connection device further comprises a module aligning portion corresponding to the cabinet aligning portion.

5. The refrigerator according to claim 3, wherein the module connection device further comprises a module guide formed in a shape corresponding to the cabinet guide and configured to be guided by the cabinet guide.

6. The refrigerator according to claim 5, wherein:

the cabinet guide is formed in a groove shape, and the module guide is formed in a protrusion shape and is configured to be inserted into the cabinet guide.

7. The refrigerator according to claim 6, wherein:

the cabinet connection device further comprises a cabinet terminal disposed at an inner end of the cabinet guide, and the module connection device further comprises a module terminal protruding from an end of the module guide and is configured to be electrically connected to the cabinet terminal.

8. The refrigerator according to claim 1, wherein:

the cabinet fixing member comprises a cabinet fixing opening through which a portion of the cabinet connector is inserted and fixed, and a cabinet wire electrically connecting the cabinet connector to the electronic device is disposed to pass through the cabinet fixing opening.

9. The refrigerator according to claim 8, wherein the cabinet connector comprises a cabinet leg inserted into and fixed to the cabinet fixing opening.

10. The refrigerator according to claim 9, wherein:

the cabinet connector further comprises a cabinet connector protrusion comprising a material having elasticity, and the cabinet connector is supported by the cabinet fixing member in a direction opposite to a direction in which the cabinet leg is supported.

11. The refrigerator according to claim 1, wherein the module connection device comprises further a module buffer member disposed between the module fixing member and the module connector, the module buffer member comprised of a material having elasticity.

12. The refrigerator according to claim 1, wherein:

the module fixing member further comprises a module fixing opening through which a portion of the module connector is inserted and fixed, and a module wire electrically connecting the module connector to the cool air supply system is disposed to pass through the module fixing opening.

13. The refrigerator according to claim 12, wherein the module connector further comprises a module leg inserted into and fixed to the module fixing opening.

14. The refrigerator according to claim 13, wherein:

the module connector further comprises a module connector protrusion comprising a material having elasticity, and the module connector is supported by the module fixing member in a direction opposite to a direction in which the module leg is supported.

15. The refrigerator according to claim 14, wherein the module connector protrusion is configured to be in contact with an inner surface of the module fixing member to limit movement of the module connector.

16. A refrigerator comprising:

a cabinet in which an electronic device is disposed;

a cooling module provided with a cooling air supply system and detachably mounted on an outer side of the cabinet;

a cabinet connection device electrically connected to the electronic device and comprising:

a cabinet fixing member fixed to the cabinet, and a cabinet connector mounted to the cabinet fixing member and provided with a cabinet guide extending along a direction in which the cooling module is coupled to the cabinet; and a module connection device electrically connected to the cooling air supply system and comprising:

a module fixing member fixed to the cooling module, and a module connector mounted to the module fixing member and provided with a module guide formed in a shape corresponding to the cabinet guide to be guided by the cabinet guide.

17. The refrigerator according to claim 16, wherein:

the cabinet connection device further comprises a cabinet buffer member disposed between the cabinet fixing member and the cabinet connector, the cabinet buffer member comprised of a material having elasticity, and the module connection device further comprises a module buffer member disposed between the module fixing member and the module connector, the module buffer member comprised of a material having elasticity.

18. The refrigerator according to claim 16, wherein:

the cabinet fixing member comprises a cabinet fixing opening through which a portion of the cabinet connector is inserted and fixed and through which a cabinet wire electrically connecting the cabinet connector to the electronic device passes, and the module fixing member comprises a module fixing opening through which a portion of the module connector is inserted and fixed and through which a module wire electrically connecting the module connector to the cool air supply system passes.

19. The refrigerator according to claim 18, wherein:

the cabinet connector comprises a cabinet leg inserted into and fixed to the cabinet fixing opening, and the module connector comprises a module leg inserted into and fixed to the module fixing opening.

20. The refrigerator according to claim 19, wherein:

the cabinet connector further comprises a cabinet connector protrusion comprising a material having elasticity and the cabinet connector is supported by the cabinet fixing member in a direction opposite to a direction in which the cabinet leg is supported, and the module connector further comprises a module connector protrusion comprising a material having elasticity and the module connector is supported by the module fixing member in a direction opposite to a direction in which the module leg is supported.

* * * * *